United States Patent [19]

Hirano et al.

[11] 4,444,870

[45] Apr. 24, 1984

[54] SILVER HALIDE COLOR PHOTOGRAPHIC LIGHT-SENSITIVE MATERIAL

[75] Inventors: Tsumoru Hirano; Keiji Mihayashi; Morio Yagihara, all of Kanagawa, Japan

[73] Assignee: Fuji Photo Film Co., Ltd., Kanagawa, Japan

[21] Appl. No.: 415,295

[22] Filed: Sep. 7, 1982

[30] Foreign Application Priority Data

Sep. 7, 1981 [JP] Japan ..... 56-140667

[51] Int. Cl.[3] ..... G03C 7/16

[52] U.S. Cl. ..... 430/381; 430/548; 430/552; 430/553; 430/554; 430/555; 430/556; 430/557; 430/558; 523/201; 525/902

[58] Field of Search ..... 430/381, 548, 552–558; 523/201; 525/281, 296, 902; 427/222

[56] References Cited

U.S. PATENT DOCUMENTS 3,787,522 1/1974 Dickie et al. ..... 525/902
4,080,211 3/1978 Van Paesschen et al. ..... 430/548
4,128,427 12/1978 Monbaliu et al. ..... 430/548
4,308,335 12/1981 Yamamoto et al. ..... 525/902
4,340,664 7/1982 Monbaliu et al. ..... 430/548

*Primary Examiner*—J. Travis Brown
*Attorney, Agent, or Firm*—Sughrue, Mion, Zinn, Macpeak and Seas

[57] ABSTRACT

A silver halide color photographic light-sensitive material comprising a support having thereon a layer containing at least one copolymer coupler latex having a layered structure capable of forming a dye upon coupling with an oxidation product of an aromatic primary amine developing agent. The polymer coupler latex having a layered structure has an exceptionally good color forming property and is capable of forming a dye with a high yield and without the formation of undesired stains and fogs. The silver halide color photographic light-sensitive material containing the polymer coupler latex has good film strength and a reduced layer thickness and provides a color image having an improved sharpness. A method of forming a color image using the silver halide color photographic light-sensitive material is also disclosed.

27 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a novel polymer coupler latex having a layered structure capable of coupling with an oxidation product of an aromatic primary amine developing agent.

BACKGROUND OF THE INVENTION

It is well known that for the color development of a silver halide photographic light-sensitive material, after exposure, an oxidized aromatic primary amine developing agent can be reacted with a dye forming coupler to obtain a color image.

It is also known that, for the color development of a silver halide color photographic material, an oxidized aromatic primary amine color developing agent can be reacted with a coupler to form a dye such as an indophenol, an indoaniline, an indamine, an azomethine, a phenoxazine, a phenazine, and the like, thus forming a color image. In this procedure, the subtractive color process is ordinarily used for color reproduction, and silver halide emulsions which are selectively sensitive to blue, green, and red light, and yellow, magenta, and cyan color image formers, which are respectively the complementary colors of blue, green, and red, are employed. For example, a coupler of the acylacetanilide or benzoylmethane type is used for forming a yellow color image; a coupler of the pyrazolone, pyrazolobenzimidazole, cyanoacetophenone or indazolone type is generally used for forming a magenta color image; and a phenolic coupler, such as a phenol and a naphthol, is generally used for forming a cyan color image.

It is also known that, in addition to color couplers which do not have a substituent at the coupling position thereof, and thus require development of 4 mols of exposed silver halide for forming 1 mol of a dye, there are color couplers which have a substituent capable of being released upon color development at the coupling position thereof, and thus require development of only 2 mols of exposed silver halide for forming 1 mol of a dye. The former are known as 4-equivalent color couplers, and the latter are known as 2-equivalent color couplers.

Color couplers must satisfy various requirements. For example, it is necessary that they provide a dye image having a good spectral property and excellent stability to light, temperature, and humidity for a long period of time upon color development.

It is also required in a multilayer color photographic light-sensitive material that each coupler is fixed in a layer separated from each other in order to reduce color mixing and to improve color reproduction. Many methods for rendering a coupler diffusion-resistant are known. One method is to introduce a long chain aliphatic group into a coupler molecule in order to prevent diffusion. Couplers according to such a method require a step of addition to an aqueous gelatin solution by solubilizing in alkali, or a step of dispersing in an aqueous gelatin solution by dissolving in a high boiling point organic solvent, since the couplers are immiscible with an aqueous gelatin solution. Such color couplers may cause crystal formation in a photographic emulsion and, in the case of using a high boiling point organic solvent, a large amount of gelatin must be employed since the high boiling point organic solvent makes an emulsion layer soft. Consequently, this brings about an opposite result to the requirement in that a thickness of the emulsion layer be reduced.

Another method for rendering a coupler diffusion-resistant is to utilize a polymer coupler obtained by polymerization of a monomeric coupler. However, such polymer couplers have disadvantages, in that they have poor solubility to water, and they increase the viscosity of an aqueous gelatin solution. In order to overcome these disadvantages, polymer coupler latexes have been provided. The method of adding a polymer coupler in a latex form to a hydrophilic colloid composition has many advantages in comparison with other methods. For example, when the polymer coupler latex is used, the step of adding the coupler to a coating solution can be simplified, since the use of a high boiling point organic solvent or an alkali is not necessary and a special dispersing method is not required. Further, the deterioration of strength of the film formed is small, because the hydrophobic substance is in a latex form. Also, the thickness of the layer can be reduced, since an organic solvent is not contained therein. Furthermore, since the latex can contain coupler monomers in a high concentration, it is easy to incorporate couplers in a high concentration into a photographic emulsion, and the increase of viscosity is small. Moreover, color mixing is prevented, since a polymer coupler is completely immobilized. Accordingly, there is only a small amount of coupler crystallization in the emulsion layer.

Examples of polymer couplers latexes described above include a 4-equivalent magenta polymer coupler latex (methods of preparation are disclosed in U.S. Pat. Nos. 3,451,820 and 4,080,211 and British Pat. No. 1,247,688), a copolymer latex of a competing coupler (as disclosed in West German Pat. No. 2,725,591 and U.S. Pat. No. 3,926,436), and a cyan polymer coupler latex (as disclosed in U.S. Pat. No. 3,767,412).

However, these polymer coupler latexes have a number of problems in addition to the many advantages described above. The problems include the following:

With respect to the polymerization technique, it should be noted that since a solid monomer coupler has low solubility, crystallization of the monomer coupler and coagulation of a latex occur, which prevents polymerization in a high concentration.

Emulsion polymerization methods of a solid water-insoluble monomer coupler in water are described in U.S. Pat. No. 4,080,211 and Belgian Pat. No. 669,971.

A first polymerization method comprises dissolving a solid water-insoluble monomer coupler in an ethylenically unsaturated copolymerizable monomer and a water-miscible or water-immiscible organic solvent, then adding the resulting solution to an aqueous reaction medium containing an emulsifier and initiating polymerization. The organic solvent capable of using in this method, however, must satisfy the following requirements: (1) it is substantially inert to the solid water-insoluble monomer coupler, (2) it does not interrupt the normal action of the free-radical addition polymerization, and (3) it has a low boiling point which makes it possible to easily remove it from the aqueous reaction medium by distillation during and/or after the polymerization.

A second polymerization method comprises dissolving a solid water-insoluble monomer coupler in an ethylenically unsaturated copolymerizable monomer, then adding the resulting solution to an aqueous reaction medium containing an emulsifier and initiating polymerization.

A third polymerization method comprises dispersing a solid water-insoluble monomer coupler and an ethylenically unsaturated copolymerizable monomer or a solid water-insoluble monomer coupler, an ethylenically unsaturated copolymerizable monomer and an organic solvent in an aqueous reaction medium containing an emulsifier and initiating polymerization.

However, each of these methods have disadvantages. More specifically, the first method is not desirable because large amount of the organic solvent is needed to dissolve the solid water-insoluble monomer coupler and a large amount of energy and time is required in order to remove the organic solvent employed. The second method is not desirable became the solid water-insoluble monomer coupler is apt to crystallize since the ethylenically unsaturated copolymerizable monomer has only limited solubility. The third method is not desirable because the solid water-insoluble monomer coupler is dispersed in a solid form and it is hardly dissolved in the aqueous reaction medium. Accordingly, a large amount of aggregates remain undispersed.

Further, the polymer coupler latexes prepared by polymerization by the first, second or third method have the following disadvantages.

1. The rate of the coupling reaction is poor, and thus the density of dye formed is very low.

2. Undesirable fog is readily formed upon color development.

3. The latexes cannot be stored for a long period of time since aggregation occurs in solution

SUMMARY OF THE INVENTION

An object of the present invention is to provide a novel polymer coupler latex having a layered structure in which the disadvantages in the polymerization step described above are overcome, and which has an excellent color forming property.

Another object of the present invention is to provide a novel polymer coupler latex having a layered structure which does not form undesirable fog and stain.

A further object of the present invention is to provide a color photographic light-sensitive material having a reduced layer thickness and an improved sharpness.

A further object of the present invention is to provide a color photographic light-sensitive material having good film strength.

A still further object of the present invention is to provide a method of forming a color image by development of a silver halide emulsion in the presence of a novel polymer coupler latex having a layered structure.

A still further object of the present invention is to provide a silver halide color photographic light-sensitive material containing a novel polymer coupler latex having a layered structure, and a photographic processing method or an image forming method which makes use of the material.

Other objects of the present invention will be apparent from the following detailed description and examples.

As a result of extensive investigations, it has now been found that these objects of the present invention are accomplished by a silver halide color photographic light-sensitive material comprising a support having thereon a layer containing at least one copolymer coupler latex having a layered structure capable of forming a dye upon coupling with an oxidation product of an aromatic primary amine developing agent.

DETAILED DESCRIPTION OF THE INVENTION

The polymer latex having a layered structure used herein is a polymer latex which is prepared by using seed polymerization as described in Matsumoto et al., *KOBUNSHI RONBUN SHU,* Vol. 31, No. 9, pp 576 to 586 and Yamazaki et al., *KOBUNSHI RONBUN SHU,* Vol. 33, No. 11, pp 655 to 662 (incorporated herein by reference to disclose such seed polymerization). The polymer latex having a layered structure has a structure in which two or more component polymers having a differed chemical composition and rate of compositions are not uniformly distributed in an inner layer (core) and an outer layer (shell) of a polymer particle, and the properties thereof (for example, a minimum film-forming temperature, a glass transition temperature, a stretching property, etc.) are different from those of a latex polymerized by a conventional one-stage preparation method in a particle of which the distribution of polymer composition is uniform. This fact can be recognized for example, from the results of electron microscopic analysis or analysis of a saponified state of a polymer particle surface as described in the above described literatures.

Other literatures containing the polymer latexes having a layered structure are also known, for example, *KOBUNSHI RONBUN SHU,* Vol. 33, No. 11, pp 663 (1976), *Chem, Tech.,* Vol. 3, pp 484 (1973), British Pat. Nos. 928,251, 941,064 and 1,009,486 and U.S. Pat. Nos. 3,236,793, 3,282,876, 3,291,768, 3,296,176, 3,309,330 and 3,847,856 (each of these U.S. Patents being uncorporated herein by reference to disclose such polymer latexes), British Pat. No. 1,009,486, etc.

Therefore, the polymer coupler latexes having a layered structure according to the present invention are different from polymer coupler latexes prepared by conventionally known preparation methods not only in their properties but also with respect to their particularly improved color forming property and fog preventing property which are completely unexpected.

Polymer coupler latexes of the present invention have a layered structure and are prepared as follows:

(a) at least one ethylenically unsaturated monomer which does not have an ability of oxidative coupling with an aromatic primary amine developing agent is subjected to emulsion polymerization to prepare a polymer latex in a first state polymerization, and then, (b) a monomer coupler capable of forming a dye upon coupling with an oxidation product of an aromatic primary amine developing agent and at least one non-color forming ethylenically unsaturated monomer are subjected to emulsion polymerization in an aqueous reaction medium containing an organic solvent in a second stage polymerization.

In general, the non-color forming ethylenically unsaturated monomer (which does not couple with an oxidation product of an aromatic primary amine developing agent used in the first stage polymerization) may be any water-insoluble monomer which is copolymerizable with a monomer coupler and is a liquid at a polymerization temperature (specifically from 50° C. to 95° C. and preferably, from 70° C. to 90° C.).

Examples of the non-color forming monomers include an alkyl ester or an alkylamide derived from an acrylic acid (for example, acrylic acid, an α-chloroacrylic acid, and an α-alkylacrylic acid such as a methacrylic acid having 1 to 20, preferably 1 to 10, carbon atoms in the alkyl moiety, for example, t-butylacrylamide, methyl acrylate, methyl methacrylate; ethyl acrylate, n-propyl acrylate, n-butyl acrylate n-butyl methacrylate, 2-ethylhexyl acrylate, n-hexyl acrylate, octyl methacrylate, lauryl methacrylate, etc., a vinyl alkanoate ester having 1 to 20, preferably 1 to 20, carbon atoms in the alkanoate moiety, for example, vinyl acetate, vinyl propionate, vinyl laurate, etc., arcylonitrile, methacrylonitrile, and aromatic vinyl compounds, for example, styrene and a derivative thereof, for example, vinyl toluene, divinyl benzene, vinyl acetophenone, a vinyl alkyl ether having 1 to 20, preferably 1 to 10, carbon atoms in the alkyl moiety, for example, vinyl ethyl ether, an alkyl ester of maleic acid having 1 to 20, preferably 1 to 10, carbon atom in the alkyl moiety, and the like.

Of these monomers, an ester of acrylic acid, an ester of methacrylic acid and an ester of maleic acid are particularly preferred.

Two or more non-color forming ethylenically unsaturated monomers described above can be used together. The non-color forming ethylenically unsaturated monomer is generally used in an amount of from 2 to 100% by weight and preferably, from 5 to 40% by weight per the total amount of a water-soluble monomer coupler and a non-color forming ethylenically unsaturated monomer employed in the second stage polymerization.

The water-insoluble monomer coupler capable of forming a dye upon coupling with an oxidation product of an aromatic primary amine devloping agent is represented by the following general formula (I).

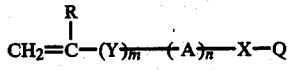

(I)

wherein R represents a hydrogen atom, a lower alkyl group containing from 1 to 4 carbon atoms, or a chlorine atom; X represents —CONH—, —NHCONH—, —NHCOO—, —COO—, —$SO_2$—, —CO— or —O—; Y represents —CONH— or —COO—; A represents an unsubstituted or substituted alkylene group containing from 1 to 10 carbon atoms which may be a straight chain or a branched chain or an unsubstituted or substituted phenylene group (for example, methylene, methylemethylene, dimethylmethylene, dimethylene, trimethylene, decylmethylene, etc.); Q represents a cyan color forming coupler residue, a magenta color forming coupler residue or a yellow color forming coupler residue each of which is capable of forming a dye upon coupling with an oxidation product of an aromatic primary amine developing agent; m represents 0 to 1; and n represents 0 or 1.

Substituents for the alkylene group or the phenylene group represented by A include an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like. When two or more substituents are present, they may be the same or different.

Of the color forming coupler residues represented by Q, a phenol type residue represented by the general formula (II) described below and a naphthol type residue represented by the general formula (III) described below are preferred as a cyan color forming coupler residue.

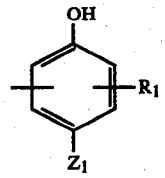

(II)

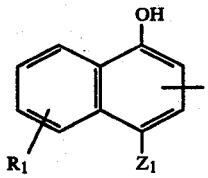

(III)

wherein $R_1$ represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, a arylcarbamoyl group, an arylamido group, an arylsulfamoyl group, an arylsulfonamido group or an arylureido group. When two or more these substituents are present, they may be the same or different.

$Z_1$ in the general formula (II) or (III) represents a hydrogen atom, a halogen atom, a sulfo group, an acyloxy group, an alkoxy group, an aryloxy group, a heterocyclic oxy group an alkylthio group, an arylthio group or a heterocyclic thio group, and these groups may be further substituted with an aryl group (for example, a phenyl group, etc.), a nitro group, a hydroxy group, a cyano group, a sulfo group, an alkoxy group (for example, a methoxy group, etc.), an aryloxy group (for example, a phenoxy group, etc.), an acyloxy group (for example, an acetoxy group, etc.), an acylamino group (for example, an acetylamino group, etc.), a sulfonamido group (for example, a methanesulfonamido group, etc.), a sulfamoyl group (for example, a methylsulfamoyl group, etc.), a halogen atom (for example, a fluorine atom, a chlorine atom, a bromine atom, etc.), a carboxy group, a carbamoyl group (for example, a methylcarbamoyl group, etc.), an alkoxycarbonyl group (for example, a methoxycarbonyl group, etc.), a sulfonyl group (for example, a methylsulfonyl group, etc.), and the like.

Preferred examples of magenta color forming coupler residues include a pyrazolone type residue and an indazolone type residue. For example, a residue represented by the following general formula (IV) is preferred.

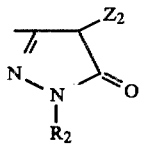

(IV)

wherein $R_2$ represents a substituent well known as a substituent at the 1-position of a 2-pyrazolin-5-one coupler, for example, an alkyl group, a substituted alkyl group (for example, a haloalkyl group such as a fluoroalkyl group, etc., a cyanoalkyl group, a benzylalkyl group, etc.), an aryl group or a substituted aryl group. Substituents for the aryl group include an alkyl group (for example, a methyl group, an ethyl group, etc.), an alkoxy group (for example, a methoxy group, an ethoxy group, etc.), an aryloxy group (for example, a phenoxy group, etc.), an alkoxycarbonyl group (for example, a methoxycarbonyl group, etc.), an acylamino group (for example, an acetylamino group, etc.), a carbamoyl group, an alkylcarbamoyl group (for example, a methylcarbamoyl group, an ethylcarbamoyl group, etc.), a dialkylcarbamoyl group (for example, a dimethylcarbamoyl group, etc.), an arylcarbamoyl group (for example, a phenylcarbamoyl group, etc.), an alkylsulfonyl group (for example, a methylsulfonyl group, etc.), an arylsulfonyl group (for example, a phenylsulfonyl group, etc.), an alkylsulfonamide group (for example, a methanesulfonamido group, etc.), an arylsulfonamido group (for example, a phenylsulfonamido group, etc.), a sulfamoyl group, an alkylsulfamoyl group (for example, an ethylsulfamoyl group, etc.), a dialkylsulfamoyl group (for example, a dimethylsulfamoyl group, etc.), an alkylthio group (for example, a methylthio group, etc.), an arylthio group (for example, a phenylthio group, etc.), a cyano group, a nitro group, a halogen atom (for example, a fluorine atom, a chlorine atom, a bromine atom, etc.), and the like. When two or more substituents are present, they may be the same or different. Particularly preferred substituents for the aryl group include a halogen atom, an alkyl group, an alkoxy group, an alkoxycarbonyl group and a cyano group.

$Z_2$ in the general formula (IV) represents a hydrogen atom or a releasing group which is connected to the coupling position of the color forming coupler through an oxygen atom, a nitrogen atom or a sulfur atom. When $Z_2$ represents a releasing group connected to the coupling position through an oxygen atom, a nitrogen or a sulfur atom, each of these atoms is bonded to an alkyl group, an aryl group, an alkylsulfonyl group, an arylsulfonyl group, an alkylcarbonyl group, an arylcarbonyl group or a heterocyclic group and the alkyl group, the aryl group and the heterocyclic group may be substituted with a substituent defined as the substituent for the aryl group represented by $R_2$ above. Further, when $Z_2$ represents a releasing group connected to the coupling position through a nitrogen atom, $Z_2$ represents a 5-membered or 6-membered heterocyclic group containing the nitrogen atom (for example, an imidazolyl group, a pyrazolyl group, a triazolyl group, a tetrazolyl group, etc.).

As a yellow color forming coupler residue, an acylacetanilide type residue, and particularly a pivaloylacetanilide type residue represented by the general formula (V) described below and a benzoylacetanilide type residue represented by the general formula (VI) or (VII) described below are preferred.

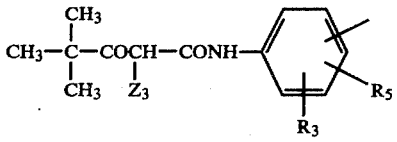

[V]

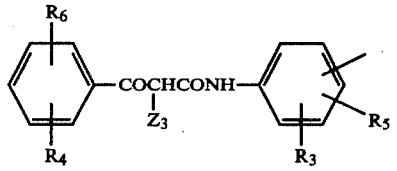

[VI]

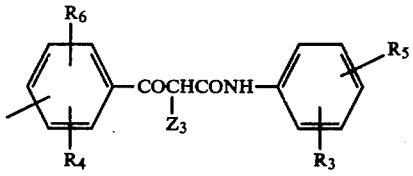

[VII]

wherein $R_3$, $R_4$, $R_5$ and $R_6$, which may be the same or different, each represents a hydrogen atom or a well known substituent for a yellow color forming coupler, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkylsubstituted succinimido group, an aryloxy group, an aryloxycarbonyl group, an arylcarbamoyl group, an arylamido group, an arylsulfamoyl group, an arylsulfonamido group, an arylureido group, a carboxy group, a sulfo group, a nitro group, a cyano group or a thiocyano group.

$Z_3$ in the general formula (V), (VI) or (VII) represents a hydrogen atom or a group represented by the general formula (VIII), (IX), (X) or (XI).

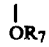

(VIII)

wherein $R_7$ represents an unsubstituted or substituted aryl group or an unsubstituted or substituted heterocyclic group.

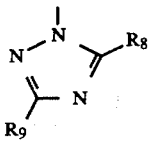

(IX)

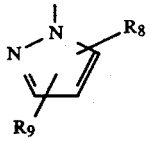

(X)

wherein $R_8$ and $R_9$, which may be the same or different, each represents a hydrogen atom, a halogen atom, a carboxylic acid ester group, an amino group, an alkyl group, an alkylthio group, an alkoxy group, an alkylsulfonyl group, a carboxylic acid group, a sulfonic acid group, an unsubstituted or substituted aryl group or an unsubstituted or substitubed heterocyclic group.

[XI]

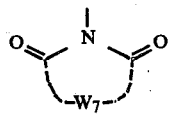

wherein $W_1$ represents non-metallic atoms necessary to form a 4-membered ring, a 5-membered ring or a 6-membered ring together with

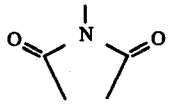

Of the groups represented by the general formula (XI), a preferred group is represented by the following general formula (XII), (XIII) or (XIV):

[XII]

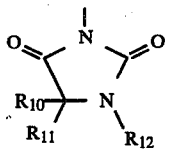

[XIII]

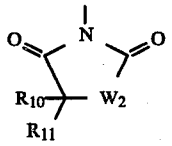

[XIV]

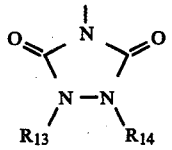

wherein $R_{10}$ and $R_{11}$, which may be the same or different, each represents a hydrogen atom, an alkyl group, an aryl group, an alkoxy group, an aryloxy group or a hydroxy group; $R_{12}$, $R_{13}$ and $R_{14}$, which may be the same or different, each represents a hydrogen atom, an alkyl group, an aryl group, an aralkyl group or an acyl group; and $W_2$ represents an oxygen atom or a sulfur atom.

The non-color forming ethylenically unsaturated monomer used in the second stage polymerization may be the same as the monomer used in the first stage polymerization. However, it is not always necessary for the non-color forming ethylenically unsaturated monomer used in the first stage polymerization to be the same monomer as that used stage polymerization to be the same monomer as that used in the second stage polymerization. Further, two or more monomers can be used together. It is also possible to copolymerize together with a non-color forming water-soluble monomer to the extent that it does not interrupt the formation of a polymer coupler latex.

Examples of the non-color forming monomer which can be used in the second stage polymerization include an alkyl ester or an alkylamide derived from an acrylic acid, (for example, acrylic acid, an $\alpha$-chloroacrylic acid, an $\alpha$-alkylacrylic acid such as methacrylic acid) having 1 to 20, preferably 1 to 10, carbon atoms in the alkyl moiety, (for example, acrylamide, methacrylamide, t-butylacrylamide, methyl acrylate, ethyl acrylate, n-propyl acrylate, n-butyl acrylate, 2-ethylhexyl acrylate, n-hexyl acrylate, octyl methacrylate, lauryl methacrylate, etc.), methylenebisacrylamide, a vinyl alkanoate ester having 1 to 20, preferably 1 to 10, carbon atoms in the alkyl moiety (for example, vinyl acetate, vinyl propionate, vinyl laurate, etc.), acrylonitrile, methacrylonitrile, an aromatic vinyl compound (for example, styrene and a derivative thereof such as vinyl toluene, divinyl benzene, sulfo styrene, vinyl acetophenone, etc.), itaconic acid, citraconic acid, crotonic acid, vinylidene chloride, a vinyl alkyl ether having 1 to 20, preferably 1 to 10 carbon atom in the alkyl moiety (for example, vinyl ethyl ether, etc.) an alkyl ester of maleic acid having 1 to 20, preferably 1 to 10, carbon atoms in the alkyl moiety, N-vinyl-2-pyrrolidone, N-vinyl-pyridine, 2- or 4-vinylpyridine, etc.

The organic solvent used in the preparation of the latex according to the present invention is preferably an organic solvent (1) which is substantially inert to the solid water-insoluble monomer coupler employed, (2) which does not interrupt the normal action of the free-radical addition polymerization and (3) which has a low boiling point so as to be capable of being easily removed by distillation from the aqueous reaction medium during and/or after the polymerization. Examples of preferred organic solvents include a lower alcohol containing 1 to 4 carbon atoms (for example, methanol, ethanol, and isopropanol, etc.), a ketone (for example, acetone, etc.), a chlorinated hydrocarbon (for example, chloroform, etc.), an aromatic hydrocarbon (for example, benzene, etc.), a cyclic ether (for example, tetrahydrofuran, etc.), an ester (for example, ethyl acetate, etc.), a nitrile (for example, acetonitrile, etc.).

The non-color forming ethylenically unsaturated monomer which is used to copolymerize with the above described water-insoluble monomer coupler can be selected so that the copolymer to be formed possesses good physical properties and/or chemical properties, for example, solubility, compatibility with a binder such as gelatin in a photographic colloid composition, flexibility, heat stability, etc., as well known in the field of polymer color couplers.

Free radical polymerization of an ethylenically unsaturated solid monomer is initiated with the addition to the monomer molecule of a free radical which is formed by thermal decomposition of a chemical initiator, the action of a reducing agent to an oxidative compound (a redox initiator) or physical action, for example, irradiation of ultraviolet rays or other high energy radiations, high frequencies, etc.

Examples of the chemical initiators commonly used include a water soluble initiator, for example, a persulfate (such as ammonium persulfate, potassium persulfate, etc.), hydrogen peroxide, 4,4'-azobis(4-cyanovaleric acid), etc., and a water insoluble initiator, for example, azoisobutyronitrile, benzoyl peroxide, chlorobenzoyl peroxide, and other compounds. Examples of the redox initiators usually used include hydrogen peroxide-iron (II) salt, potassium persulfate-potassium hydrogensulfate, cerium salt-alcohol, etc. Specific examples and functions of the initiators are described in F. A.

Bovey, *Emulsion Polymerization,* pages 59 to 93, (Interscience Publishes Inc., New York (1955)).

As an emulsifier which can be used in the emulsion polymerization, a compound having surface activity is used. Preferred examples include soap, a sulfonate, a sulfate, a cationic compound, an amphoteric compound and a high molecular weight protective colloid. Specific examples and functions of the emulsifiers are described in *Belgische Chemische Industrie,* Vol. 28, pages 16 to 20 (1963).

A ratio of the water-insoluble monomer coupler and the non-color forming ethylenically unsaturated monomer can be varied in a range from 5 to 100% by weight of the water-insoluble monomer coupler. However, a ratio from 20 to 70% by weight is preferred in view of color reproducibility, color forming property and stability. In this case, an equivalent molecular weight, that is, a gram number of the polymer containing 1 mol of a monomer coupler is from about 250 to 4,000, but it is not limited thereto.

Examples of the monomer couplers suitable for the preparation of the polymer coupler latex having a layered structure by copolymerization according to the present invention are described in various literatures, for example, Belgian Pat. Nos. 584,494, 602,516 and 669,971, British Pat. Nos. 967,503, 1,130,581, 1,247,688 and 1,269,355, U.S. Pat. Nos. 3,356,686 and 3,767,412, (all of which are incorporated herein by reference to disclose such monomer couplers) etc.

Typical examples of the monomer couplers used in the present invention are set forth below, but the present invention is not to be construed as being limited thereto.

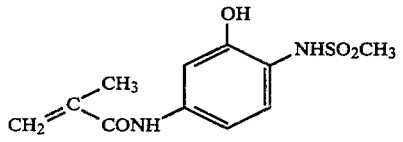

(C-1)

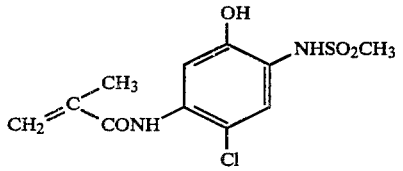

(C-2)

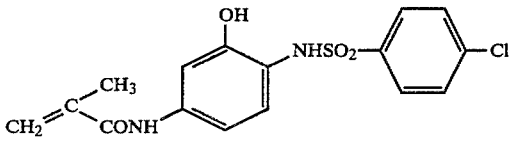

(C-3)

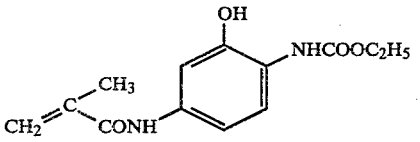

(C-4)

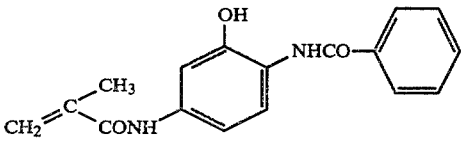

(C-5)

-continued

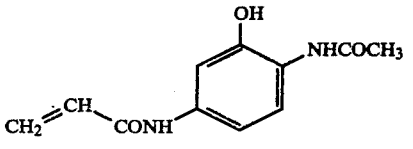

(C-6)

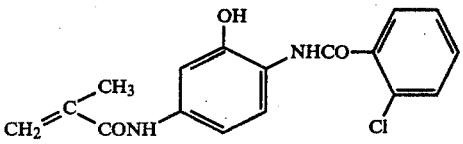

(C-7)

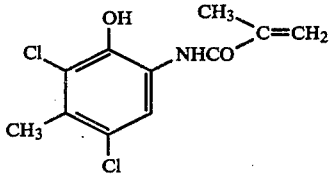

(C-8)

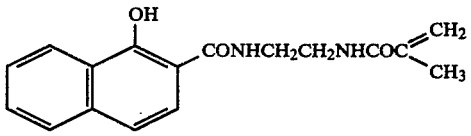

(C-9)

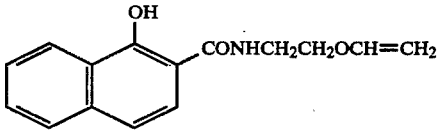

(C-10)

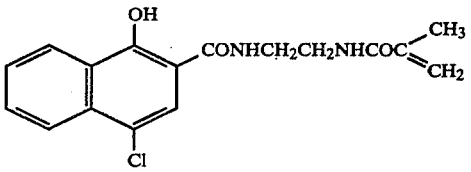

(C-11)

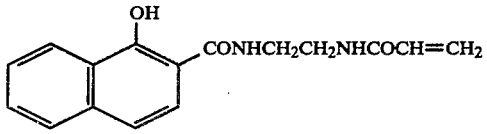

(C-12)

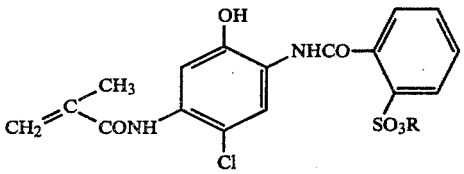

(C-13)

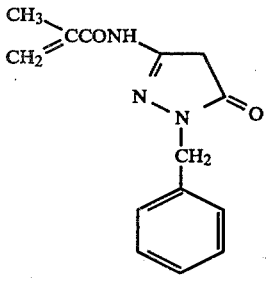

(M-1)

-continued
(M-2)
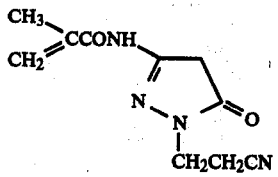
(M-3)
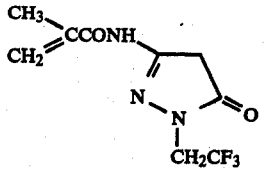
(M-4)
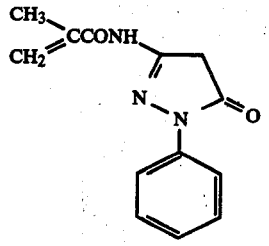
(M-5)
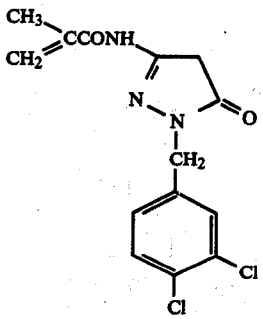
(M-6)
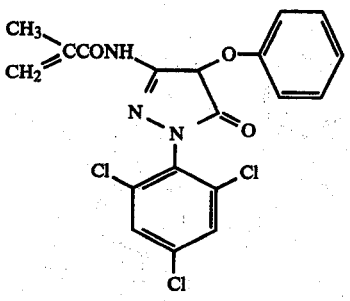
(M-7)
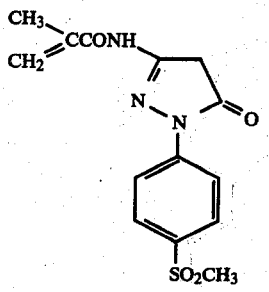
-continued
(M-8)
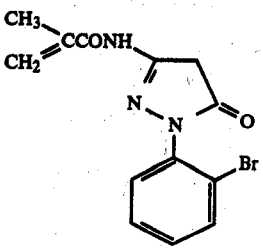
(M-9)
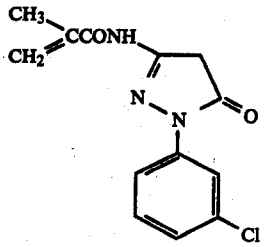
(M-10)
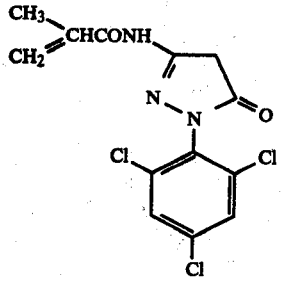
(M-11)
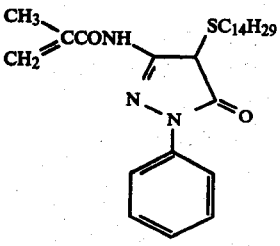
(M-12)
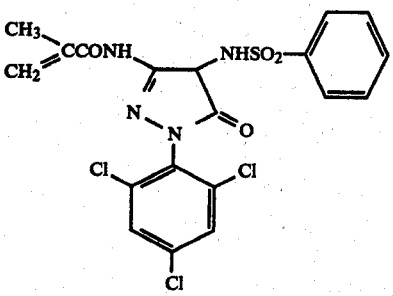
(M-13)
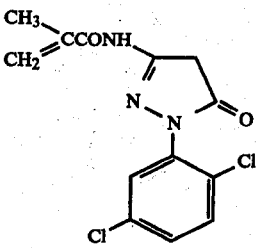

-continued
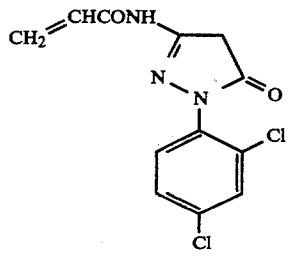
(M-14)
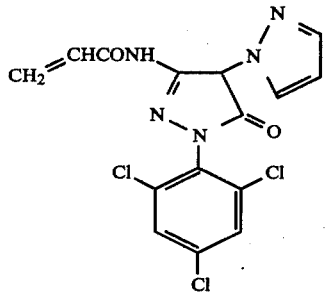
(M-15)
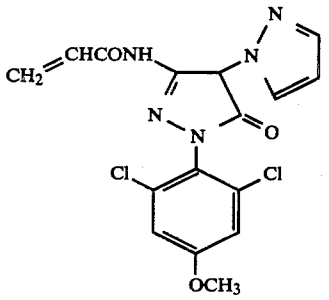
(M-16)
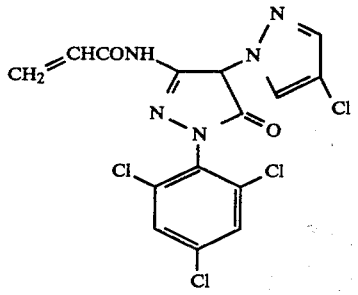
(M-17)
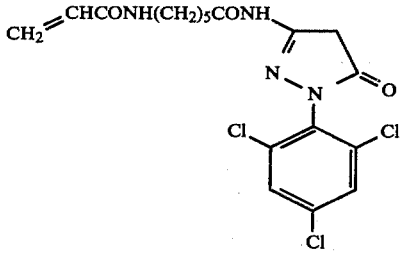
(M-18)
-continued
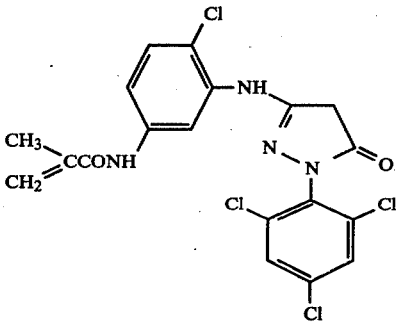
(M-19)
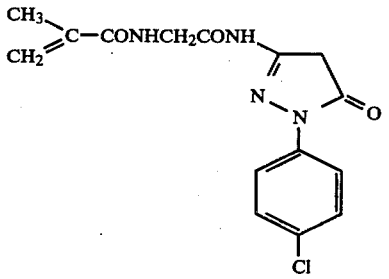
(M-20)
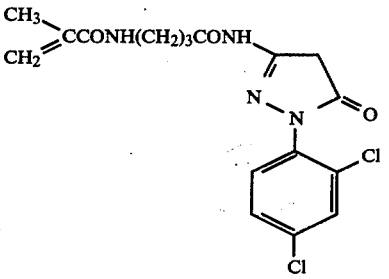
(M-21)
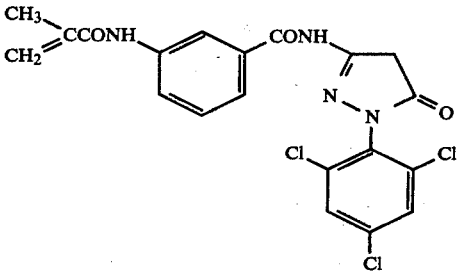
(M-22)
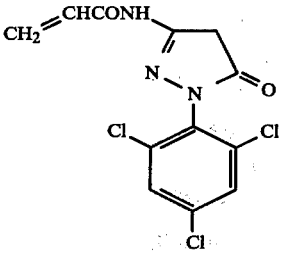
(M-23)

-continued (M-24)

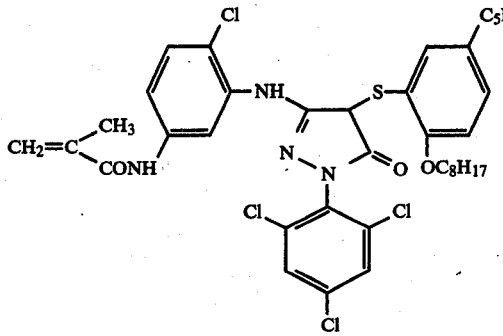

(Y-1)

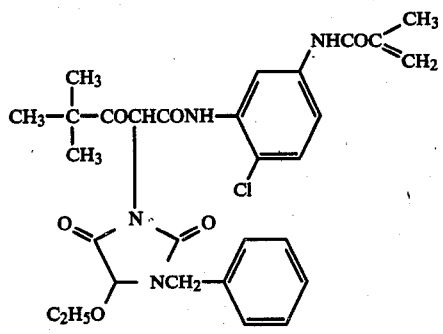

(Y-2)

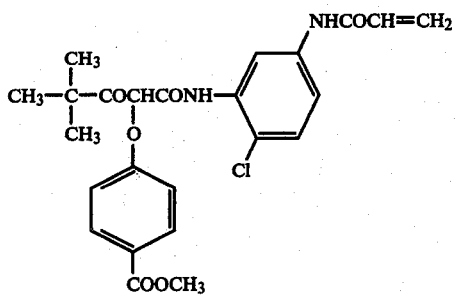

(Y-3)

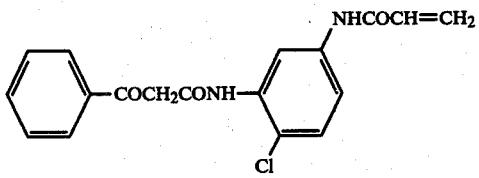

(Y-4)

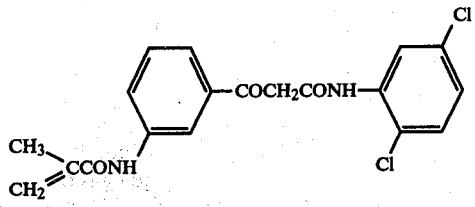

-continued (Y-5)

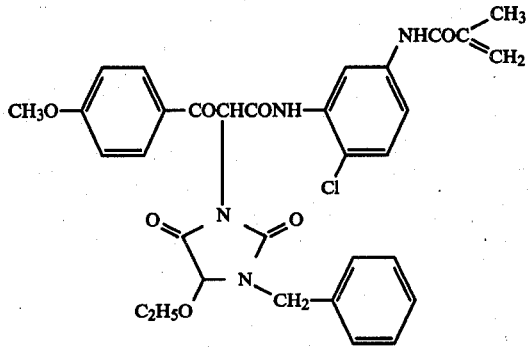

(Y-6)

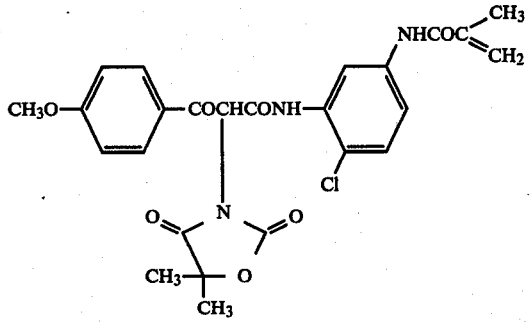

(Y-7)

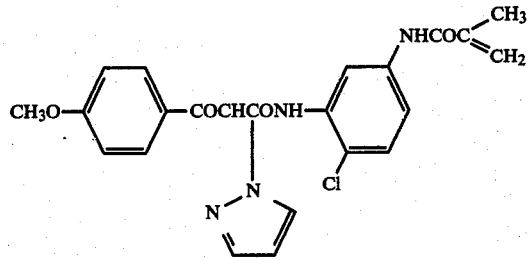

(Y-8)

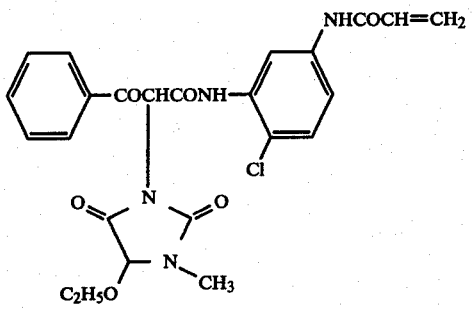

Typical synthesis examples of the polymer coupler latex having a layered structure used in the present invention are set forth below.

SYNTHESIS EXAMPLE 1

Copolymer latex of 1-(2,5-dichlorophenyl)-3-methacryloylamino-2-pyrazolin-5-one [Monomer Coupler (M-13)] and ethyl acrylate having a layered structure [Polymer Coupler Latex (A) having a layered structure].

400 ml of an aqueous solution containing 0.88 g of oleyl methyl tauride was stirred in a 1 liter flask and heated to 80° C. while introducing nitrogen gas through the solution. To the mixture, 2 ml of a 2% aqueous solution of potassium persulfate and 4 g of ethyl acrylate were added. After being reacted for 1 hour, 20 g of Monomer Coupler (M-13), 20 g of ethyl acrylate and 200 ml of ethanol were added to the mixture. Then 14 ml of a 2% aqueous solution of potassium persulfate was added and after being reacted for 1 hour 6 ml of a 2% aqueous solution of potassium persulfate was further added. After being further reacted for 1 hour, the ethyl acrylate not reacted and the ethanol were distilled off. The latex thus formed was cooled, filtered, and the pH of the latex solution was adjusted to 6.0 with a 1 N sodium hydroxide solution. The concentration of the polymer in the latex formed was 10.3% and it was found that the polymer synthesized contained 45.9% of Monomer Coupler (M-13) as the result of nitrogen analysis.

SYNTHESIS EXAMPLE 2

Copolymer latex of 1-(2,4,6-trichlorophenyl)-3-(3-methacryloylaminobenzoylamino)-2-pyrazolin-5-one [Monomer Coupler (M-22)] and butyl acrylate having a layered structure [Polymer Coupler Latex (B) having a layered structure].

400 ml of an aqueous solution containing 5.25 g of oleyl methyl tauride was stirred in a 1 liter flask and heated to 80° C. while introducing nitrogen gas through the solution. To the mixture, 2.5 ml of a 2% aqueous solution of potassium persulfate and 5 g of n-butyl acrylate were added. After being reacted for 1 hour, 20 g of Monomer Coupler (M-22), 80 g of n-butyl acrylate and 200 ml of ethanol were added to the mixture. Then 35 ml of a 2% aqueous solution of potassium persulfate was added and after being reacted for 1 hour 15 ml of a 2% aqueous solution of potassium persulfate was further added. After being further reacted for 1 hour, the monomer not reacted and the ethanol were distilled off. The latex thus formed was cooled, filtered and the pH of the latex solution was adjusted to 6.0 with a 1N sodium hydroxide solution. The concentration of the polymer in the latex formed was 21.8% and it was found that the polymer synthesized contained 18.3% of Monomer Coupler (M-22) as the result of nitrogen analysis.

SYNTHESIS EXAMPLE 3

Copolymer latex of 1-(2,4,6-trichlorophenyl)-3-methacryloylamino-2-pyrazolin-5-one [Monomer Coupler (M-10)], n-butyl acrylate and styrene having a layered structure [Polymer Coupler Latex (C) having a layered structure].

400 ml of an aqueous solution containing 0.88 g of oleyl methyl tauride was stirred in a 1 liter flask and heated to 80° C. while introducing nitrogen gas through the solution. To the mixture, 2 ml of a 2% aqueous solution of potassium persulfate and 4 g of styrene were added. After being reacted for 1 hour, 20 g of Monomer Coupler (M-10), 20 g of n-butyl acrylate and 200 ml of ethanol were added to the mixture. Then 14 ml of a 2% aqueous solution of potassium persulfate was added and after being reacted for 1 hour 6 ml of at 2% aqueous solution of potassium persulfate was further added. After being further reacted for 1 hour, the monomer not reacted and the ethanol were distilled off. The latex thus formed was cooled, filtered and the pH of the latex solution was adjusted to 6.0 with a 1N sodium hydroxide solution. The concentration of the polymer in the latex formed was 10.8% and it was found that the polymer synthesized contained 45.2% of Monomer Coupler (M-10) as the result of nitrogen analysis.

SYNTHESIS EXAMPLE 4

Copolymer latex of α-(4-methoxybenzoyl)-α-(1-benzyl-2,4-dioxo-5-ethoxyhydantoin-3-yl)-2-chloro-5-methacryloylaminoacetanilide [Monomer Coupler (Y-5)], n-butyl acrylate and styrene having a layered structure [Polymer Coupler Latex (D) having a layered structure].

400 ml of an aqueous solution containing 2.2 g of oleyl methyl tauride was stirred in a 1 liter flask and heated to 80° C. while introducing nitrogen gas through the solution. To the mixture, 2 ml of a 2% aqueous solution of potassium persulfate and 4 g of styrene were added. After being reacted for 1 hour, 20 g of Monomer Coupler (Y-5), 20 g of n-butyl acrylate and 200 ml of ethanol were added to the mixture. Then 14 ml of a 2% aqueous solution of potassium persulfate was added and after being reacted for 1 hour 6 ml of a 2% aqueous solution of potassium persulfate was further added. After being further reacted for 1 hour, the monomer not reacted and the ethanol were distilled off. The latex thus formed was cooled, filtered and the pH of the latex solution was adjusted to 6.0 with a 1 N sodium hydroxide solution. The concentration of the polymer in the latex formed was 10.3% and it was found that the polymer synthesized contained 45.7% of Monomer Coupler (Y-5) as the result of nitrogen analysis.

SYNTHESIS EXAMPLE 5

Copolymer latex of α-(4-methoxybenzoyl)-α-(1-pyrazolyl)-2-chloro-5-methacryloylaminoacetanilide [Monomer Coupler (Y-7)], n-butyl acrylate and ethyl acrylate having a layered structure [Polymer Coupler Latex (E) having a layered structure].

400 ml of an aqueous solution containing 5.5 g of sodium salt of oleyl methyl tauride was stirred in a 1 liter flask and heated to 80° C. while introducing nitrogen gas through the solution. To the mixture, 1.5 ml of a 10% aqueous solution of sodium salt of 4,4'-azobis(4-cyanovaleric acid) and 15 g of ethyl acrylate were added. After being reacted for 1 hour, 20 g of Monomer Coupler (Y-7), 80 g of n-butyl acrylate and 150 ml of ethanol were added to the mixture. Then 7 ml of a 10% aqueous solution of sodium salt of 4,4'-azobis(4-cyanovaleric acid) was added and after being reacted for 1 hour 3 ml of a 10% aqueous solution of sodium salt of 4,4'-azobis(4-cyanovaleric acid) was further added. After being further reacted for 1 hour, the monomer not reacted and the ethanol were distilled off. The latex thus formed was cooled, filtered and the pH of the latex solution was adjusted to 6.0 with a 1 N sodium hydroxide solution. The concentration of the polymer in the latex formed was 29.5% and it was found that the polymer synthesized contained 17.2% of Monomer Coupler (Y-7) as the result of nitrogen analysis.

SYNTHESIS EXAMPLE 5

Copolymer Latex of 1-phenyl-3-methacryloylamino-2-pyrazolin-5-one [Monomer Coupler (M-4)] and n-butyl acrylate having a layered structure [Polymer Coupler Latex (F) having a layered structure].

400 ml of an aqueous solution containing 1.0 g of oleyl methyl tauride was stirred in a 1 liter flask and heated to 80° C. while introducing nitrogen gas through the solution. To the mixture, 1 ml of a 2% aqueous solution of potassium persulfate and 5 g of n-butyl acrylate were added. After being reacted for 1 hour, 20 g of Monomer Coupler (M-4), 20 g of n-butyl acrylate and 150 ml of methanol were added to the mixture. Then 7 ml of a 2% aqueous solution of potassium persulfate was added and after being reacted for 1 hour 3 ml of a 2% aqueous solution of potassium persulfate was further added. After being further reacted for 1 hour, the monomer not reacted and the ethanol were distilled off. The latex thus formed was cooled, filtered and the pH of the latex solution was adjusted to 6.0 with a 1 N sodium hydroxide solution. The concentration of the polymer in the latex formed was 10.7% and it was found that the polymer synthesized contained 47.3% of Monomer Coupler (M-4) as the result of nitrogen analysis.

SYNTHESIS EXAMPLE 7

Copolymer Latex of 1-(2,4,6-trichlorophenyl)-3-acryloylamino-2-pyrazolin-5 one [Monomer Coupler (M-23)], ethyl acrylate and methyl methacrylate having a layered structure [Polymer Coupler Latex (G) having a layered structure].

300 ml of an aqueous solution containing 1.1 g of oleyl methyl tauride was stirred in a 1 liter flask and heated to 80° C. while introducing nitrogen gas through the solution. To the mixture, 2 ml of a 2% aqueous solution of potassium persulfate and 2 g of methyl methacrylate were added. After being reacted for 1 hour, 20 g of Monomer Coupler (M-23), 20 g of ethyl acrylate and 180 ml of ethanol were added to the mixture. Then 14 ml of a 2% aqueous solution of potassium persulfate was added and after being reacted for 1 hour 7 ml of a 2% aqueous solution of potassium persulfate was further added. After being further reacted for 1 hour, the monomer not reacted and the ethanol were distilled off. The latex thus formed was cooled, filtered and the pH of the latex solution was adjusted to 6.0 with a 1 N sodium hydroxide solution. The concentration of the polymer in the latex formed was 15.6% and it was found that the polymer synthesized contained 46.5% of Monomer Coupler (M-23) as the result of nitrogen analysis.

Polymer Coupler Latexes (H) to (W) having a layered structure synthesized in the manner as described in Synthesis Examples 1 to 7 are set forth below.

| Polymer Coupler Latex having a layered structure | Seed Monomer | Amount (g) | Monomer added later | Amount (g) | Monomer added later | Amount (g) | Solid Concentration in Latex (%) | Coupler Content in Polymer (%) |
|---|---|---|---|---|---|---|---|---|
| (H) | BA | 10 | C - 2 | 20 | BA | 80 | 24.5 | 18.0 |
| (I) | St | 4 | C - 8 | 20 | EHA | 40 | 14.4 | 30.8 |
| (J) | MMA | 5 | C - 9 | 20 | EA | 20 | 11.2 | 41.3 |
| | | | | | MAA | 2 | | |
| (K) | BA | 2 | M - 1 | 20 | BA | 20 | 10.6 | 45.5 |
| (L) | BA | 3 | M - 3 | 10 | EA | 10 | 10.7 | 42.8 |
| (M) | St | 2 | M - 7 | 20 | EHA | 10 | 7.4 | 61.2 |
| (N) | MA | 3 | M - 9 | 10 | MA | 40 | 23.9 | 18.3 |
| (O) | EA | 2 | M - 11 | 10 | EA | 10 | 10.3 | 45.1 |
| (P) | BMA | 4 | M - 15 | 10 | BA | 40 | 24.2 | 17.5 |
| (Q) | MMA | 3 | M - 16 | 10 | BA | 20 | 14.5 | 28.4 |
| (R) | St | 5 | M - 18 | 10 | EA | 40 | 23.7 | 17.6 |
| (S) | BA | 9 | M - 19 | 30 | EHA | 15 | 8.2 | 55.6 |
| (T) | BA | 5 | M - 20 | 10 | BA | 20 | 24.5 | 17.6 |
| | | | | | MA | 20 | | |
| (U) | EA | 5 | Y - 1 | 10 | EHA | 40 | 24.2 | 17.3 |
| (V) | BA | 10 | Y - 4 | 20 | BA | 80 | 24.9 | 17.9 |
| (W) | St | 5 | Y - 6 | 20 | BA | 20 | 10.8 | 40.8 |
| | | | | | MAA | 2 | | |

MA: Methyl Acrylate
EHA: 2-Ethylhexyl Acrylate
St: Styrene
EA: Ethyl Acrylate
MMA: Methyl Methacrylate
MAA: Methacrylic Acid
BA: n-Butyl Acrylate
BMA: n-Butyl Methacrylate The polymer coupler latex having a layered structure according to the present invention is generally incorporated into a silver halide emulsion layer of the silver halide photographic light-sensitive material, but it may be incorporated into an adjacent layer to the silver halide emulsion layer.

The polymer coupler latex having a layered structure according to the present invention is incorporated into one or more layers selected from a blue-sensitive emulsion layer, an adjacent layer thereto, a green-sensitive emulsion layer, an adjacent layer thereto, a red-sensitive emulsion layer, an adjacent layer thereto of the silver halide photographic light-sensitive material. Usually, a yellow color image forming polymer coupler latex having a layered structure is incorporated into a blue-sensitive emulsion layer and/or an adjacent layer thereto, a magenta color image forming polymer coupler latex having a layered structure is incorporated into a green-sensitive emulsion layer and/or an adjacent layer thereto and a cyan color image forming polymer coupler latex having a layered structure is incorporated into a red-sensitive emulsion layer and/or an adjacent layer thereto.

In the production of the color photographic light-sensitive material according to the present invention, well known conventional couplers can be used together with the polymer coupler latex having a layered structure. Couplers which form a color image of the same color as that formed from the polymer coupler latex having a layered structure according to the present invention or couplers which form a color image of a different color from that formed from the polymer coupler latex having a layered structure according to the present invention may be used. Further, colored couplers providing a color correction effect, or couplers which release a development inhibitor upon development can be used together. Also, couplers which provide a colorless product on coupling reaction can be used. Non-diffusible couplers which contain a hydrophobic group, called a ballast group, in the molecule thereof are preferred as couplers, although polymer couplers as described in U.S. Pat. Nos. 4,080,211, 4,128,427, 3,163,625, 3,451,820 and 4,215,195, European Pat. No. 27,284 and water-soluble couplers containing a sulfonic acid group or a carboxylic acid group can be used.

Examples of useful magenta color forming couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

Conventional open chain ketomethylene type couplers can be employed as yellow color forming couplers. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76 and 87650/75, etc.

Phenol type compounds, naphthol type compounds, etc., can be employed as cyan color forming couplers. Specific examples of cyan color forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76 and 73050/80, etc.

Further, development inhibitor releasing (DIR) couplers as described, for example, in U.S. Pat. Nos. 3,148,062, 3,227,554, 3,733,201, 3,617,291, 3,703,375, 3,615,506, 3,265,506, 3,620,745, 3,632,345, 3,869,291, 3,642,485, 3,770,436 and 3,808,945, British Pat. Nos. 1,201,110 and 1,236,767, etc.; colored cyan couplers as described, for example, in U.S. Pat. Nos. 3,583,971, 3,844,795 and 4,004,929, Japanese Patent Publication No. 10729/75, Japanese Patent Application (OPI) Nos. 94923/75, 26034/76 and 110328/76, etc.; colored magenta couplers as described, for example, in U.S. Pat. No. 2,449,966, West German Pat. No. 2,024,186, Japanese Patent Application (OPI) Nos. 123625/74, 131448/74 and 42121/77, etc.; competing couplers as described, for example, in U.S. Pat. Nos. 3,876,428, 3,580,722, 2,998,314, 2,808,329, 2,742,832 and 2,689,793, etc. can be employed.

Two or more kinds of the couplers described above can be incorporated into the same layer, or the same coupler compound can also be present in two or more layers.

A known method such as described in U.S. Pat. No. 2,322,027, can be used to incorporate the couplers described above into a silver halide emulsion layer. The coupler is dispersed in a hydrophilic colloid and then mixed with a silver halide emulsion.

In order to satisfy the characteristics required of the photographic light-sensitive material, the polymer coupler latex having a layered structure according to the present invention can be used in combination with dye image stabilizing agents as described, for example, in British Pat. No. 1,326,889, U.S. Pat. Nos. 3,432,300, 3,698,909, 3,574,627, 3,573,050 and 3,764,337, etc.; stain preventing agents as described, for example, in U.S. Pat. Nos. 2,336,327, 2,728,659, 2,336,327, 2,403,721, 2,701,197 and 3,700,453, etc.; DIR compounds as described, for example, in West German Patent Application (OLS) Nos. 2,529,350, 2,448,063 and 2,610,546, U.S. Pat. Nos. 3,928,041, 3,958,993, 3,961,959, 4,049,455, 4,052,213, 3,579,529, 3,043,690, 3,364,022, 3,297,445 and 3,287,129, etc., and the like.

When couplers having an acid group such as a carboxylic acid group, a sulfonic acid group, etc., are used, they can be incorporated into a hydrophilic colloid as an alkaline aqueous solution thereof.

The silver halide emulsions which can be used in the present invention are those wherein silver chloride, silver bromide, or a mixed silver halide such as silver chlorobromide, silver iodobromide, or silver chloroiodobromide is finely dispersed in a hydrophilic polymer such as gelatin. The silver halide can be chosen depending on the intended use of the photographic light-sensitive material from dispersions having a uniform grain size or those having a wide grain size distribution or from dispersions having an average grain size of from about 0.1 micron to about 3 microns. These silver halide emulsions can be prepared, for example, by a single jet method, by a double jet method or a controlled double jet method, or by a ripening method such as an ammonia method, a neutral method or an acidic method. Also, these silver halide emulsions can be subjected to chemical sensitization such as a sulfur sensitization, a gold sensitization, a reduction sensitization, etc., and can contain a speed increasing agent such as a polyoxyethylene compound, an onium compound, etc. Further, a silver halide emulsion of the type wherein latent images are predominantly formed on the surface of the grains or of the internal latent image type where latent images are predominantly formed inside the grains can be used in the present invention. Also, two or more kinds of silver halide photographic emulsions prepared separately and then mixed can be employed.

As a hydrophilic high molecular weight substance composed of the photographic light-sensitive layer of the present invention, a protein such as gelatin, etc., a high molecular weight non-electrolyte such as polyvinyl alcohol, polyvinyl pyrrolidone, polyacrylamide, etc., an acidic high molecular weight substance such as an alginate, a polyacrylic acid salt, etc., a high molecular weight ampholite such as a polyacrylamide treated by the Hoffmann rearrangement reaction, a copolymer of acrylic acid and N-vinylimidazole, etc., a cross-linking polymer as described in U.S. Pat. No. 4,215,195, and the like are suitable. Furthermore, a hydrophobic high molecular weight dispersion such as a latex of polybutyl acrylate, etc., can be included in the continuous phase of such a hydrophilic high molecular weight substance.

The silver halide emulsion used in the present invention can be chemically sensitized, as noted above, using conventional methods. Examples of suitable chemical sensitizers include, for example, gold compounds such as chloroaurates and gold trichloride as described in U.S. Pat. Nos. 2,399,083, 2,540,085, 2,597,856, and 2,597,915; salts of a noble metal, such as platinum, palladium, iridium, rhodium and ruthenium, as described in U.S. Pat. Nos. 2,448,060, 2,540,086, 2,566,245, 2,566,263 and 2,598,079; sulfur compounds capable of forming silver sulfide by reacting with a silver salt, such as those described in U.S. Pat. Nos. 1,574,944, 2,410,689, 3,189,458 and 3,501,313; stannous salts, amines, and other reducing compounds such as those described in U.S. Pat. Nos. 2,487,850, 2,518,698, 2,521,925, 2,521,926, 2,694,637, 2,983,610 and 3,201,254 and the like.

Various compounds can be added to the photographic emulsions used in the present invention in order to prevent a reduction of the sensitivity or a formation of fog during preparation, storage, or processing of the photographic light-sensitive material. A wide variety of such compounds are known, such as heterocyclic compounds, mercury-containing compounds, mercapto compounds or metal salts, including 4-hydroxy-6-methyl-1,3,3a,7-tetraazaindene, 3-methylbenzothiazole and 1-phenyl-5-mercaptotetrazole. Other examples of such compounds which can be used are described, for example, in U.S. Pat. Nos. 1,758,576, 2,110,178, 2,131,038, 2,173,628, 2,697,040, 2,304,962, 2,324,123, 2,394,198, 2,444,605, 2,444,606, 2,444,607, 2,444,608, 2,566,245, 2,694,716, 2,697,099, 2,708,162, 2,728,663 2,728,664, 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, British Pat. Nos. 893,428, 403,789, 1,173,609 and 1,200,188, as well as in K. Mees, *The Theory of the Photographic Process,* 3rd Ed. (1966) and the literature references cited herein.

The photographic emulsion used in the present invention can also contain one or more surface active agents. These surface active agents are commonly used as a coating aid. However, in some cases they are used as an emulsifier, a dispersant, a sensitizer, an antistatic agent, or an adhesion preventing agent.

The surface active agents can be classified into various groups, as follows: natural surface active agents such as saponin; nonionic surface active agents such as alkylene oxides, glycerols and glycidols; cationic surface active agents such as higher alkylamines, quaternary ammonium salts, heterocyclic compounds such as pyridine and the like, phosphoniums or sulfoniums; anionic surface active agents containing an acid group such as a carboxylic acid group, a sulfonic acid group, a phosphoric acid group, a sulfuric acid ester group, or phosphoric acid ester group; amphoteric surface active agents such as aminoacids, aminosulfonic acids, aminoalcohol sulfuric acid esters or aminoalcohol phosphoric acid esters. Some examples of those surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,971, West German Patent Application (OLS) No. 1,942,665, British Pat. Nos. 1,077,317 and 1,198,450, as well as Ryohei Oda et al., *Kaimenkasseizai no Gosei to sono Oyo* (*Synthesis and Application of Surface Active Agents*), Maki Shoten (1964), A. W. Perry, *Surface Active Agents,* Interscience Publications, Inc. (1958) and J. P. Sisley, *Encyclopedia of Surface Active Agents,* Vol. II, Chemical Publishing Co. (1964).

The photographic emulsions can be spectrally sensitized, or supersensitized, using a cyanine-type dye, such as a cyanine, merocyanine, carbocyanine, etc., individually, in combinations, or in combination with a styryl dye.

These spectral sensitization techniques are well known, and are described, for example, in U.S. Pat. Nos. 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68 and 14030/69, etc. The sensitizers can be selected as desired depending on the wavelength range or the sensitivity to be sensitized or the purposes and use of the photographic materials to be sensitized.

The hydrophilic colloid layer, and in particular a gelatin layer in the photographic light-sensitive material used in the present invention, can be hardened using various kinds of cross-linking agents. For instance, an inorganic compound such as a chromium salt and a zirconium salt, or an aldehyde type cross-linking agent such as mucochloric acid, or 2-phenoxy-3-chloromaldealdehydic acid as described in Japanese Patent Publication No. 1872/71 can be effectively used in the present invention, but non-aldehyde type cross-linking agents such as compounds having plural epoxy rings as described in Japanese Patent Publication No. 7133/59, the poly(1-aziridinyl) compounds as described in Japanese Patent Publication No. 8790/62, the active halogen compounds as described in U.S. Pat. Nos. 3,362,827 and 3,325,287 and the vinyl sulfone compounds as described in U.S. Pat. Nos. 2,994,611 and 3,582,322, Belgian Pat. No. 686,440, etc., are particularly suitable for use in the photographic light-sensitive material of the present invention.

The silver halide photographic emulsion of the present invention is suitably applied to a support. Illustrative supports include rigid materials such as glass, metal and ceramic, and flexible materials and the type of support chosen depends on the end-use objects. Typical examples of flexible supports include a cellulose nitrate film, a cellulose acetate film, a polyvinyl acetal film, a polystyrene film, a polyethylene terephthalate film, a polycarbonate film and a laminate thereof, a baryta coated paper, a paper coated with an $\alpha$-olefin polymer, such as polyethylene, polypropylene and an ethylene-butene copolymer, a plastic film having a roughened surface as described in Japanese Patent Publication No. 19068/72, and the like. Depending upon the end-use objects of the photographic light-sensitive material, the support can be transparent, colored by adding a dye or pigment, opaque by adding, for example, titanium white, or light-shielding by adding, for example, carbon black.

The layer of the photographic light-sensitive material can be coated on a support using various coating methods, including a dip coating method, an air-knife coating method, a curtain coating method, an extrusion coating method using a hopper as described in U.S. Pat. No. 2,681,294. Also two or more layers can be coated simultaneously, using methods as described in U.S. Pat. Nos. 2,761,791, 3,508,947, 2,941,898, 3,526,528, etc.

The present invention is applicable to not only the so-called multilayer type photographic light-sensitive material comprising a support having superimposed thereon emulsion layers, each of which is sensitive to radiation of a substantially different wavelength region and forms color images of a substantially different hue, but also the so-called mixed-packet type photographic light-sensitive material comprising a support having coated thereon a layer containing packets which are sensitive to radiation of substantially different wavelength regions and form color images of a substantially different hue. The present invention can be applied to a color negative film, a color positive film, a color reversal film, a color printing paper, a color reversal printing paper, and the like.

The color photographic light-sensitive material of the present invention is, after exposure, subjected to a development processing to form dye images. Development processing includes basically a color development step, a bleaching step and a fixing step. Each step can be carried out individually or two or more steps can be combined as one step where a processing solution having two or more functions is used. Also, each step can be separated into two or more steps. The development processing can further include a pre-hardening step, a neutralization step, a first development (black-and-white development) step, a stabilizing step, a water washing step, and the like, if desired. The temperature of processing can be varied depending on the photographic light-sensitive material, the processing method, and the like. In general, the processing steps are carried out at a temperature from 18° C. to 60° C. These steps need not necessarily be conducted at the same temperature.

A color developer solution is an alkaline solution having a pH of more than 8, preferably from 9 to 12, and containing, as a developing agent, a compound whose oxidation product is capable of forming a colored compound when reacted with a color forming agent, i.e., a color coupler. The developing agent described above includes a compound capable of developing an exposed silver halide and having a primary amino group on an aromatic ring, and a precursor which forms such compound. Typical examples of preferred developing agents are, for example, 4-amino-N,N-diethylaniline, 3-methyl-4-amino-N,N-diethylaniline, 4-amino-N-ethyl-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-ethoxyethylaniline, 4-amino-3-methoxy-N-ethyl-N-β-methoxyethylaniline, 4-amino-3-β-methanesulfonamidoethyl-N,N-diethylaniline, and the salts thereof (for example, the sulfates, the hydrochlorides, the p-toluene sulfonates, and the like). Other developing agents such as those described in U.S. Pat. Nos. 2,193,015 and 2,592,364, Japanese Patent Application (OPI) No. 64933/73, L. F. A. Mason, *Photographic Processing Chemistry,* pages 226–229, Focal Press, London (1966), T. H. James, *The Theory of the Photographic Process,* 4th Edition, pages 315–320, Macmillan, New York (1977), etc., can be used. Further, an aminophenol as described in T. H. James, *The Theory of the Photographic Process,* 4th Edition, pages 311–315, etc., can be used. Also, a 3-pyrazolidone can be used together with these developing agents.

The color developer solution can optionally contain various additives. Typical examples of such additives include alkaline agents (for example, alkali metal or ammonium hydroxides, carbonates or phosphates); pH-adjusting agents or buffers (for example, weak acids such as acetic acid, boric acid, etc., weak bases, or salts thereof); developing accelerators (for example, various pyridinium compounds or cationic compounds such as those described in U.S. Pat. Nos. 2,648,604 and 3,671,247; potassium nitrate; sodium nitrate; condensation products of polyethylene glycol, and their derivatives such as those described in U.S. Pat. Nos. 2,533,990, 2,577,127 and 2,950,970; nonionic compounds such as polythioethers represented by those described in British Pat. Nos. 1,020,032 and 1,020,033; polymeric compounds having sulfite ester groups such as those described in U.S. Pat. No. 3,068,097; organic amines such as pyridine and ethanolamine; benzyl alcohol; hydrazines and the like); antifogging agents (for example, alkali metal bromides; alkali metal iodides; nitrobenzimidazoles such as those described in U.S. Pat. Nos. 2,496,940 and 2,656,271; mercaptobenzimidazole; 5-methylbenzotriazole; 1-phenyl-5-mercaptotetrazole; compounds for use in rapid processing such as those described in U.S. Pat. Nos. 3,113,864, 3,342,596, 3,295,976, 3,615,522 and 3,597,199, thiosulfonyl compounds such as those described in British Pat. No. 972,211; phenazine-N-oxides such as those described in Japanese Patent Publication No. 41675/71; those described in *Kagaku Shashin Binran* (*Manual of Scientific Photography*), Vol. II, pages 29–47, and the like); stain or sludge preventing agents such as those described in U.S. Pat. Nos. 3,161,513 and 3,161,514, and British Pat. Nos. 1,030,442, 1,144,481 and 1,251,558; interlayer-effect accelerators disclosed in U.S. Pat. No. 3,536,487; preservatives (for example, sulfites, bisulfites, hydroxyamine hydrochloride, formsulfite, alkanolaminesulfite adducts, etc.) and the like.

The color photographic light-sensitive material of the present invention can be treated with various solutions prior to color development.

In the case of color reversal films, treatment with a first development solution is also carried out prior to the color development. As the first development solution, an alkaline aqueous solution containing at least one developing agent, such as hydroquinone, 1-phenyl-3-pyrazolidone, N-methyl-p-aminophenyl and the like can be employed. The solution can also contain inorganic salts such as sodium sulfate; pH-adjusting agents or buffers such as borax, boric acid, sodium hydroxide and sodium carbonate; development fog inhibiting agents such as alkali metal halides (such as potassium bromide, etc.), and the like.

The additives illustrated above and the amounts thereof employed are well known in the color processing field.

After color development, the color photographic material are usually bleached and fixed. The processes can be effected in a blix bath which combines the bleaching and fixing steps. Various compounds can be used as a bleaching agent, for example, ferricyanides, dichromates: water-soluble iron (III) salts, water-soluble cobalt (III) salts: water-soluble copper (II) salts: water-soluble quinones: nitrosophenols: complex salts of a polyvalent cation such as iron (III), cobalt (III), copper (II), etc., and an organic acid, for example, metal complex of an aminopolycarboxylic acid such as ethylenediaminetetraacetic acid, nitrilotriacetic acid, iminodiacetic acid, N-hydroxyethylethylenediaminetriacetic acid, etc., malonic acid, tartaric acid, malic acid, diglycolic acid and dithioglycolic acid, and copper complex salt of 2,6-dipicolinic acid; peracids such as alkylperacids, persulfates, permanganates and hydrogen peroxide; hypochlorites; chlorine; bromine; bleaching powder; and the like. These can be suitably used, individually or in combination. To the bleaching solution, bleaching accelerators such as those described in U.S. Pat. Nos. 3,042,520 and 3,241,966, Japanese Patent Publication Nos. 8506/70 and 8836/70 and various other additives can be added.

Any known fixing solution can be used for fixing the photographic materials of the present invention. That is, ammonium, sodium, or potassium thiosulfate can be used as a fixing agent at a concentration of about 50 to about 200 g/liter. Fixing solutions can further contain stabilizers such as sulfites and metabisulfites; hardeners such as potassium alum; pH buffers such as acetates and borates, and the like. The fixing solution generally has a pH of more than 3 or less..

Bleaching baths, fixing baths and blixing baths as described, for example, in U.S. Pat. No. 3,582,322, Japanese Patent Application (OPI) No. 101934/73, West German Pat. No. 1,051,117 can also be employed.

The present invention will be explained in greater detail with reference to the following examples, but the present invention should not be construed as being limited thereto.

EXAMPLE 1

70 ml of an aqueous solution containing $5.6\times10^{-3}$ mol (as coupler unit) of each of the magenta color forming polymer coupler latex (A) having a layered structure according to the present invention and comparative magenta color forming polymer coupler latexes (I), (II), (III) and (IV) (described below) was mixed with 100 g of a silver halide emulsion containing $5.6\times10^{-2}$ mol of silver iodobromide and 8 g of gelatin, and to the mixture was added 8 ml of a 4% acetone solution of 2-hydroxy-4,6-dichloro-s-triazine sodium salt. After adjusting the pH to 6.5, the emulsion was coated on a cellulose triacetate support having a subbing layer to prepare Samples 1 to 5.

These films were exposed stepwise for sensitometry and then subjected to the following color development processing.

| Color Development Processing Step | Time | Temperature (°C.) |
|---|---|---|
| 1. Color development | 3 min 15 sec | 38 |
| 2. Bleaching | 6 min 30 sec | 38 |
| 3. Washing with water | 2 min | 38 |
| 4. Fixing | 4 min | 38 |
| 5. Washing with water | 4 min | 38 |
| 6. Stabilizing bath | 1 min | 38 |

The processing solutions used in the color development processing had the following compositions:

| | |
|---|---|
| Color Developer Solution | |
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogen Carbonate | 1.2 g |
| Potassium Bromide | 1.2 g |
| Sodium Chloride | 0.2 g |
| Trisodium Nitrilotriacetate | 1.2 g |
| Water to make | 1 l |
| | (pH 10.1) |
| Bleaching Solution | |
| Water | 800 ml |
| Iron (III) Ammonium Ethylenediaminetetraacetate | 100 g |
| Disodium Ethylenediaminetetraacetate | 10 g |
| Potassium Bromide | 150 g |
| Acetic Acid | 10 g |

-continued

| | |
|---|---|
| Water to make | 1 l |
| | (pH 6.0) |
| Fixing Solution | |
| Water | 800 ml |
| Ammonium Thiosulfate | 150 g |
| Sodium Sulfite | 10 g |
| Sodium Hydrogen Sulfite | 2.5 g |
| Water to make | 1 l |
| | (pH 6.0) |
| Stabilizing Bath | |
| Water | 800 ml |
| Formalin (37 wt % formaldehyde) | 5 ml |
| Fuji Driwell | 3 ml |
| Water to make | 1 l |

The photographic properties thus-obtained are shown in Table I below.

TABLE 1

| Sample | Fog | Gamma | Relative Sensitivity | Maximum Color Density |
|---|---|---|---|---|
| 1 (Present Invention) | 0.10 | 1.48 | 100 | 2.05 |
| 2 (Comparison) | 0.16 | 0.95 | 65 | 1.62 |
| 3 (Comparison) | 0.13 | 1.21 | 82 | 1.81 |
| 4 (Comparison) | 0.12 | 1.25 | 85 | 1.82 |

It is apparent from the results shown in Table 1 that the Sample according to the present invention provides increased gamma, relative sensitivity, and maximum color density without an increase in fog in comparison with the Comparative Samples 2, 3, and 4 and thus it is clearly advantageous with respect to the color forming property.

The magenta color forming polymer coupler latexes (I), (II) and (III) used for comparison which were prepared by conventional emulsion polymerization have the following compositions. The synthesis methods of these polymer coupler latex are also described below.

| Comparative Example | Polymer Coupler Latex | Polymer Concentration in Latex (wt %) | Monomer Coupler Unit in Polymer (wt %) | Synthesis Method |
|---|---|---|---|---|
| 2 | (I) | 9.4 | 44.2 | (A)* |
| 3 | (II) | 10.1 | 44.5 | (B)* |
| 4 | (III) | 5.8 | 45.7 | (C)* |

(A)* The latex was synthesized in accordance with the synthesis method described in Example 8 of U.S. Pat. No. 4,080,211.
(B)* The latex was synthesized in accordance with the synthesis method described in Example 8 of U.S. Pat. No. 4,080,211, except using a water/ethanol system as a polymerization solvent system.
(C)* The latex was synthesized in accordance with the synthesis method described in Example 4 of U.S. Pat. No. 4,080,211.

Composition of Polymer Coupler Latex:

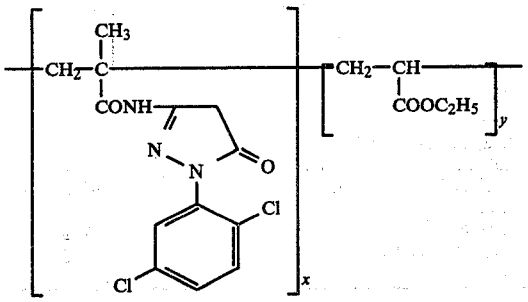

EXAMPLE 2

A solution of $7\times10^{-3}$ mol (as coupler unit) of each of the magenta color forming polymer coupler latex (B) having a layered structure according to the present invention and comparative magenta color forming polymer coupler latexes (IV), (V), (VI) and (VII), (described below), in 30 ml of water and 100 g of a silver halide emulsion containing $4\times10^{-2}$ mol of silver chlorobromide and 7 g of gelatin were mixed and to which 8 ml of a 4% acetone solution of 2-hydroxy-4,6-dichloro-s-triazine sodium salt was added. The pH of the mixture was adjusted to 6.7 and coated on a baryta coated paper, in an amount of silver coated of $4\times10^{-3}$ mol/m$^2$, to prepare Samples 6, 7, 8, 9 and 10.

These films were exposed stepwise for sensitometry and then subjected to the following color development processing.

| Color Development Processing Step | Time | Temperature (°C.) |
|---|---|---|
| 1. Color development | 3 min 30 sec | 33 |
| 2. Bleach-fixing | 1 min 30 sec | 33 |
| 3. Washing with water | 2 min 30 sec | 25 to 30 |

The processing solutions used in the color development processing had the following compositions:

| Color Developer Solution | |
|---|---|
| Benzyl Alcohol | 15 ml |
| Diethylene Glycol | 8 ml |
| Ethylenediaminetetraacetic Acid | 5 g |
| Sodium Sulfite | 2 g |
| Anhydrous Potassium Carbonate | 30 g |
| Hydroxylamine Sulfate | 3 g |
| Potassium Bromide | 0.6 g |
| 4-Amino-N—ethyl-N—(β-methanesulfonamidoethyl)-m-toluidine Sesquisulfate Monohydrate | 5 g |
| Water to make | 1 l |
| pH was adjusted to 10.20 | |

| Bleach-Fixing Solution | |
|---|---|
| Ethylenediaminetetraacetic Acid | 2 g |
| Ferric Salt of Ethylenediaminetetraacetate | 40 g |
| Sodium Sulfite | 5 g |
| Ammonium Thiosulfate | 70 g |
| Water to make | 1 l |

The photographic properties thus-obtained are shown in Table 2 below.

TABLE 2

| Sample | Fog | Gamma | Maximum Color Density |
|---|---|---|---|
| 6 (Present Invention) | 0.12 | 2.03 | 2.98 |
| 7 (Comparison) | 0.14 | 1.48 | 2.20 |
| 8 (Comparison) | 0.15 | 1.63 | 2.34 |
| 9 (Comparison) | 0.13 | 1.70 | 2.53 |
| 10 (Comparison) | 0.14 | 1.51 | 2.25 |

It is apparent from the results shown in Table 2 that Sample 6 according to the present invention provides increased gamma and maximum color density without an increase in fog in comparison with the Comparative Samples 7, 8, 9 and 10, and thus it is clearly advantageous with respect to the color forming property.

The magenta color forming polymer coupler latexes (IV), (V), (VI) and (VII) used for comparison which were prepared by conventional emulsion polymerization have the following compositions. The synthesis methods of these polymer coupler latexes are also described below.

| Comparative Example | Polymer Coupler Latex | Polymer Concentration in Latex (wt %) | Monomer Coupler Unit in Polymer (wt %) | Synthesis Method |
|---|---|---|---|---|
| 7 | (IV) | 17.8 | 17.2 | (D)* |
| 8 | (V) | 20.4 | 17.5 | (E)* |
| 9 | (VI) | 11.7 | 17.9 | (F)* |
| 10 | (VII) | 17.4 | 17.5 | (G)* |

(D)* The latex was synthesized in accordance with the synthesis method described in Example 8 of U.S. Pat. No. 4,080,211.
(E)* The latex was synthesized in accordance with the synthesis method described in Example 8 of U.S. Pat. No. 4,080,211, except using a water/ethanol system as a polymerization solvent system.
(F)* The latex was synthesized in accordance with the synthesis method described in Example 4 of U.S. Pat. No. 4,080,211.
(G)* The latex was synthesized in accordance with the synthesis method described in Example 6 of U.S. Pat. No. 4,080,211.

Composition of Polymer Coupler Latex:

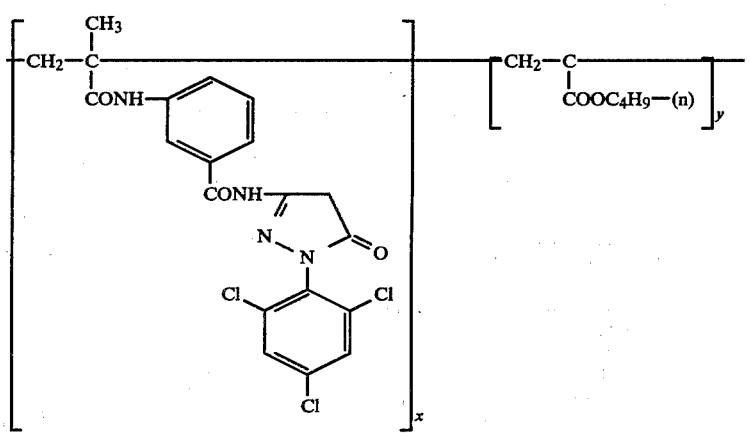

EXAMPLE 3

40 ml of an aqueous solution containing $7.5\times10^{-3}$ mol of each of the magenta color forming polymer coupler latex (C) having a layered structure according to the present invention and comparative magenta color forming polymer coupler latexes (VIII), (IX) and (X) (described below) was mixed with 100 g of a silver halide emulsion containing $8.4\times10^{-2}$ mol of silver iodobromide and 10 g of gelatin and to which 8 ml of a 4% acetone solution of 2-hydroxy-4,6-dichloro-s-triazine sodium salt was added. The pH of the mixture was adjusted to 6.7 and the mixture was coated on a cellulose triacetate film in an amount of silver coated of $2.5\times10^{-3}$ mol/m$^2$, to prepare Samples 11, 12, 13 and 14.

These films were exposed stepwise for sensitometry and then subjected to the following color development processing.

| Color Development Processing Step (38° C.) | Time (min.) |
|---|---|
| 1. First development | 3 |
| 2. Washing with water | 1 |
| 3. Reversal | 2 |
| 4. Color development | 6 |
| 5. Control | 2 |
| 6. Bleaching | 6 |
| 7. Fixing | 4 |
| 8. Washing with water | 4 |
| 9. Stabilizing | 1 |
| 10. Drying | |

The processing solutions used in the color development processing had the following compositions:

| | |
|---|---|
| First Developments Solution | |
| Water | 800 ml |
| Sodium Tetrapolyphosphate | 2.0 g |
| Sodium Hydrogen Sulfite | 8.0 g |
| Sodium Sulfite | 37.0 g |
| 1-Phenyl-3-pyrazolidone | 0.35 g |
| Hydroquinone | 5.5 g |
| Sodium Carbonate Monohydrate | 28.0 g |
| Potassium Bromide | 1.5 g |
| Potassium Iodide | 13.0 mg |
| Sodium Thiocyanate | 1.4 g |
| Water to make | 1.0 l |
| Reversal Solution | |
| Water | 800 ml |
| Hexasodium Nitrilo-N,N,N—trimethylene Phosphonate | 3.0 g |
| Stannous Chloride Dihydrate | 1.0 g |
| Sodium Hydroxide | 8.0 g |
| Glacial Acetic Acid | 15.0 ml |
| Water to make | 1.0 l |
| Color Developer Solution | |
| Water | 800 ml |
| Sodium Tetrapolyphosphate | 2.0 g |
| Benzyl Alcohol | 5.0 ml |
| Sodium Sulfite | 7.5 g |
| Trisodium Phosphate (12 hydrate) | 36.0 g |
| Potassium Bromide | 1.0 g |
| Potassium Iodide | 90.0 mg |
| Sodium Hydroxide | 3.0 g |
| Citrazic Acid | 1.5 g |
| 4-Amino-3-methyl-N—ethyl-N—(β-hydroxyethyl)aniline Sesquisulfate Monohydrate | 11.0 g |
| Ethylenediamine | 3.0 g |
| Water to make | 1.0 l |
| Control Solution | |

-continued

| | |
|---|---|
| Water | 800 ml |
| Glacial Acetic Acid | 5.0 ml |
| Sodium Hydroxide | 3.0 g |
| Dimethylaminoethaneisothiourea Dihydrochloride | 1.0 g |
| Water to make | 1.0 l |
| Bleaching Solution | |
| Water | 800 ml |
| Sodium Ethylenediaminetetraacetate Dihydrate | 2.0 g |
| Ammonium Iron (II) Ethylenediamine tetraacetate Dihydrate | 120.0 g |
| Potassium Bromide | 100.0 g |
| Water to make | 1.0 l |
| Fixing Solution | |
| Water | 800 ml |
| Ammonium Thiosulfate | 80.0 g |
| Sodium Sulfite | 5.0 g |
| Sodium Hydrogen Sulfite | 5.0 g |
| Water to make | 1.0 l |
| Stabilizing Bath | |
| Water | 800 ml |
| Formalin (37 wt % formaldehyde) | 5.0 ml |
| Fuji Driwell | 5.0 ml |
| Water to make | 1.0 l |

The photographic properties thus-obtained are shown in Table 3 below.

TABLE 3

| Sample | Fog | Gamma | Maximum Color Density |
|---|---|---|---|
| 11 (Present Invention) | 0.03 | 1.15 | 2.21 |
| 12 (Comparison) | 0.03 | 0.68 | 1.35 |
| 13 (Comparison) | 0.03 | 0.82 | 1.58 |
| 14 (Comparison) | 0.03 | 0.95 | 1.67 |

It is apparent from the results shown in Table 3 that the polymer coupler latex having a layered structure according to the present invention has good color forming properties in comparison with the comparative magenta polymer coupler latexes.

The magenta color forming polymer coupler latexes (VIII), (IX) and (X) used for comparison which were prepared by conventional emulsion polymerization have the following compositions. The synthesis methods of these polymer coupler latexes are also described below.

| Comparative Example | Polymer Coupler Latex | Polymer Concentration in Latex (wt %) | Monomer Coupler Unit in Polymer (wt %) | Synthesis Method |
|---|---|---|---|---|
| 12 | (VIII) | 9.5 | 43.8 | (H)* |
| 13 | (IX) | 9.9 | 44.8 | (I)* |
| 14 | (X) | 5.6 | 45.5 | (J)* |

(H)* The latex was synthesized in accordance with the synthesis method described in Example 8 of U.S. Pat. No. 4,080,211.

(I)* The latex was synthesized in accordance with the synthesis method described in Example 8 of U.S. Pat. No. 4,080,211, except using a water/ethanol system as a polymerization solvent system.

(J)* The latex was synthesized in accordance with the synthesis method described in Example 4 of U.S. Pat. No. 4,080,211.

Composition of Polymer Coupler Latex:

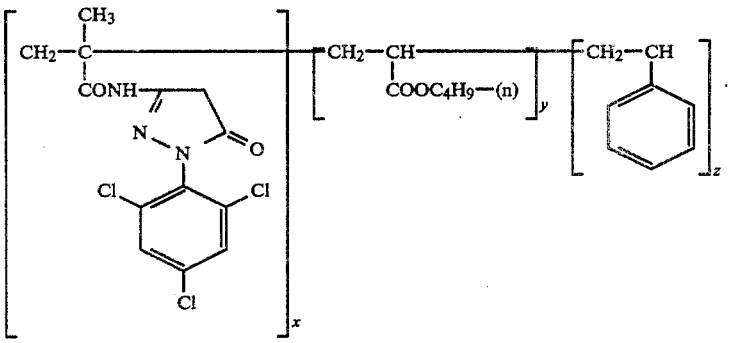

EXAMPLE 4

100 ml of an aqueous solution containing $1.2\times10^{-2}$ mol (as coupler unit) of each of the yellow color forming polymer coupler latex (D) having a layered structure according to the present invention and comparative yellow polymer coupler latexes (XI), (XII) and (XIII) (described below) was mixed with 100 g of silver halide emulsion containing $6\times10^{-2}$ mol of silver iodobromide and 8 g of gelatin and to which 8 ml of a 4% acetone solution of 2-hydroxy-4,6-dichloro-s-triazine sodium salt was added. The pH of the mixture was adjusted to 6.5 and the mixture was coated on a cellulose triacetate support having a subbing layer to prepare Samples 15, 16, 17 and 18.

These films were exposed stepwise for sensitometry and then subjected to color development processing as described in Example 1 above. The results thus-obtained are shown in Table 4 below.

TABLE 4

| Sample | Fog | Gamma | Maximum Color Density |
|---|---|---|---|
| 15 (Present Invention) | 0.07 | 1.73 | 1.85 |
| 16 (Comparison) | 0.12 | 1.43 | 0.70 |
| 17 (Comparison) | 0.10 | 1.57 | 0.92 |
| 18 (Comparison) | 0.09 | 1.65 | 1.31 |

It is apparent from the results shown in Table 4 that yellow color forming polymer coupler latex having a layered structure according to the present invention has good color forming properties in comparison with the comparative yellow polymer coupler latexes.

The yellow color forming polymer coupler latexes (XI), (XII) and (XIII) used for comparison which were prepared by conventional emulsion polymerization have the following compositions. The synthesis methods of these polymer coupler latexes are also described below.

| Comparative Example | Polymer Coupler Latex | Polymer Concentration in Latex (wt %) | Monomer Coupler Unit in Polymer (wt %) | Synthesis Method |
|---|---|---|---|---|
| 16 | (XI) | 9.2 | 45.3 | (K)* |
| 17 | (XII) | 9.7 | 45.1 | (L)* |
| 18 | (XIII) | 5.7 | 45.8 | (M)* |

(K)* The latex was synthesized in accordance with the synthesis method described in Example 8 of U.S. Pat. No. 4,080,211.
(L)* The latex was synthesized in accordance with the synthesis method described in Example 8 of U.S. Pat. No. 4,080,211, except using a water/ethanol system as a polymerization solvent system.
(M)* The latex was synthesized in accordance with the synthesis method described in Example 4 of U.S. Pat. No. 4,080,211.

Composition of Polymer Coupler Latex:

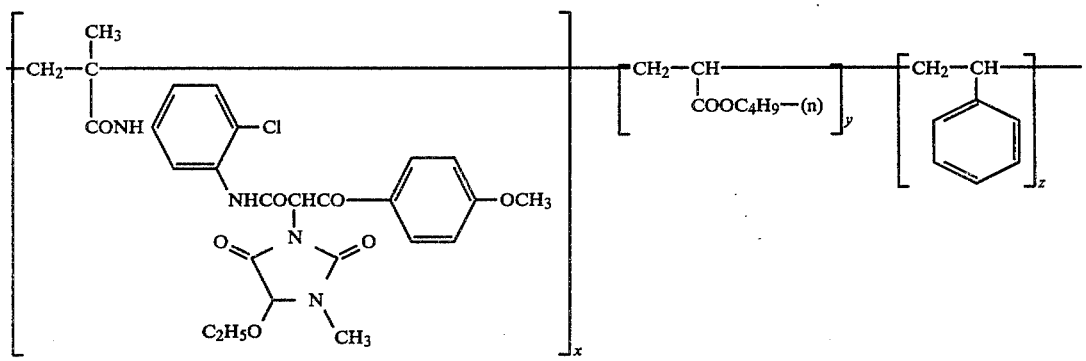

While the invention has been described in detail with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a layer containing at least one copolymer coupler latex having a layered structure which comprises an outer layer containing a polymer made from at least one monomer coupler capable of forming a dye upon coupling with an oxidation product of an aromatic primary amine developing agent and an inner layer which does not have the capability of forming a dye upon the coupling with an oxidation product of an aromatic primary amine developing agent.

2. A silver halide color photographic light-sensitive material as claimed in claim 1, wherein the copolymer coupler latex is a copolymer coupler latex prepared using a seed polymerization.

3. A silver halide color photographic light-sensitive material as claimed in claim 1, wherein the copolymer coupler latex has a structure in which a plurality of component polymers having a different chemical composition and rate of composition are randomly distributed in an inner layer (core) and in an outer layer (shell) of a polymer particle.

4. A silver halide color photographic light-sensitive material as claimed in claim 1, wherein the copolymer coupler latex is a copolymer coupler latex prepared by a method in which (a) at least one ethylenically unsaturated monomer incapable of oxidative coupling with an aromatic primary amine developing agent is subjected to emulsion polymerization to prepare a polymer latex in a first stage polymerization, and then (b) a monomer coupler capable of forming a dye upon coupling with an oxidation product of an aromatic primary amine developing agent and a non-color forming ethylenically unsaturated monomer are subjected to emulsion polymerization in an aqueous reaction medium containing an organic solvent in a second stage polymerization.

5. A silver halide color photographic light-sensitive material as claimed in claim 4, wherein the ethylenically unsaturated monomer used in the first stage polymerization is a water-insoluble monomer which is copolymerizable with a monomer coupler and a liquid at a polymerization temperature.

6. A silver halide color photographic light-sensitive material as claimed in claim 5, wherein the ethylenically unsaturated monomer used in the first stage polimerization is an acrylic acid ester, an acrylic acid amide, a vinyl ester, an acrylonitrile, an aromatic vinyl compound, a vinyl alkyl ether or an ester of maleic acid.

7. A silver halide color photographic light-sensitive material as claimed in claim 5, wherein the ethylenically unsaturated monomer used in the first stage polymerization is selected from the group consisting of an ester of acrylic acid, and an ester of maleic acid.

8. A silver halide color photographic light-sensitive material as claimed in claim 4, wherein an amount of the ethylenically unsaturated monomer used in the first stage polymerization is from 2 to 100% by weight per the total amount of a water-insoluble monomer coupler and a non-color forming ethylenically unsaturated monomer used in the second stage polymerization.

9. A silver halide color photographic light-sensitive material as claimed in claim 4, wherein the monomer coupler used in the second stage polymerization is represented by the following general formula (I)

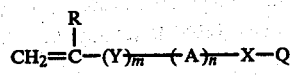

(I)

wherein R represents a hydrogen atom, a lower alkyl group having from 1 to 4 carbon atoms, or a chlorine atom; X represents —CONH—, —NHCONH—, —NHCOO—, —COO—, —$SO_2$—, —CO— or —O—; Y represents —CONH— or —COO—; A represents an unsubstituted or substituted alkylene group having from 1 to 10 carbon atoms which may be a straight chain or a branched chain or an unsubstituted or substituted phenylene group; Q represents a cyan color forming coupler residue, a magenta color forming coupler residue or a yellow color forming coupler residue each of which is capable of forming a dye upon coupling with an oxidation product of an aromatic primary amine developing agent; m represents 0 or 1; and n represents 0 or 1.

10. A silver halide color photographic light-sensitive material as claimed in claim 9, wherein the substituent for the alkylene group or the phenylene group represented by A is selected from the group consisting of an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group, or a sulfonyl group.

11. A silver halide color photographic light-sensitive material as claimed in claim 9, wherein the cyan color forming coupler residue is a phenol type residue represented by the following general formula (II) or a naphthol type residue represented by the following general formula (III):

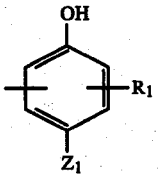

(II)

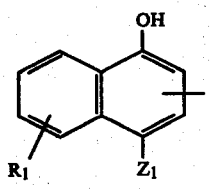

(III)

wherein $R_1$ represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an arylcarbamoyl group, an arylamido group, an arylsulfamoyl group, an arylsulfonamido group or an arylureido group; and $Z_1$ represents a hydrogen atom, a halogen atom, a sulfo group, an acyloxy group, an alkoxy group, an aryloxy group, a heterocyclic oxy group, an alkylthio group, an arylthio group or a heterocyclic thio group, and these groups may have a substituent selected from the group consisting of an aryl group, a nitro group, a hydroxy group, a cyano group, a sulfo group, an alkoxy group, an aryloxy group, an acyloxy group, an acylamino group, a sulfonamido group, a sulfamoyl group, a halogen atom, a carboxy group, a carbamoyl group, an alkoxycarbonyl group or a sulfonyl group.

12. A silver halide color photographic light-sensitive material as claimed in claim 9, wherein the magenta color forming coupler residue is a pyrazolone type residue represented by the following general formula (IV):

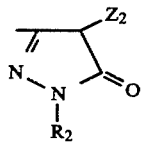

(IV)

wherein $R_2$ represents an unsubstituted or substituted alkyl group or an unsubstituted or substituted aryl group; and $Z_2$ represents a hydrogen atom or a releasing group which is convected to the coupling position of the color forming coupler through an oxygen atom, a nitrogen atom or a sulfur atom.

13. A silver halide color photographic light-sensitive material as claimed in claim 12, wherein a substituent for the substituted aryl group represented by $R_2$ is selected from the groups consisting of an alkyl group, an alkoxy group, an aryloxy group, an alkoxycarbonyl group, an acylamino group, a carbamoyl group, an alkylcarbamoyl group, a dialkylcarbamoyl group, an arylcarbamoyl group, an alkylsulfonyl group, an arylsulfonyl group, an alkylsulfonamido group, an aryl sulfonamido group, a sulfamoyl group, an alkylsulfamoyl group, a dialkylsulfamoyl group, an alkylthio group, an arylthio group, a cyano group, a nitro group, or a halogen atom.

14. A silver halide color photographic light-sensitive material as claimed in claim 13, wherein the substituent for the substituted aryl group represented by $R_2$ is selected from the groups consisting of a halogen atom, an alkyl group, an alkoxy group, an alkoxycarbonyl group, or a cyano group.

15. A silver halide color photographic light-sensitive material as claimed in claim 12, wherein the oxygen atom, the nitrogen atom or the sulfur atom in the releasing group represented by $Z_2$ is bonded to a group selected from the groups consisting of an alkyl group, an aryl group, an alkylsulfonyl group, an arylsulfonyl group, an alkylcarbonyl group, an arylcarbonyl group or a heterocyclic group.

16. A silver halide color photographic light-sensitive material as claimed in claim 12, wherein the nitrogen atom in the releasing group represented by Z forms a 5-membered or 6-membered heterocyclic ring.

17. A silver halide color photographic light-sensitive material as claimed in claim 9, wherein the yellow color forming coupler residue is a pivaloyl acetanilide type residue represented by the following general formula (V) or benzoyl acetanilide type residue represented by the following general formula (VI) or (VII):

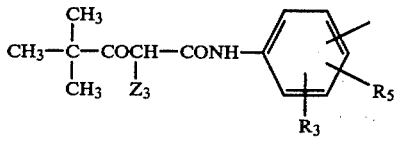

[V]

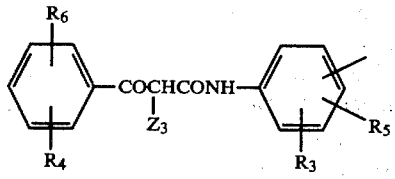

[VI]

-continued

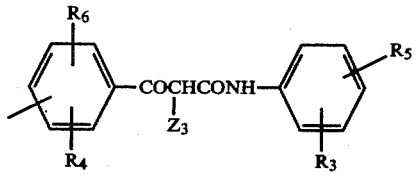

[VII]

wherein $R_3$, $R_4$, $R_5$ and $R_6$, which may be the same or different, each represents a hydrogen atom, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkylsubstituted succinimido group, an aryloxy group, an aryloxycarbonyl group, an arylcarbamoyl group, an arylamido group, an arylsulfamoyl group, an arylsulfonamido group, an arylureido group, a carboxy group, a sulfo group, a nitro group, a cyano group or a thiocyano group; and $Z_3$ represents a hydrogen atom or a group represented by the general formula (VIII), (IX), (X) or (XI)

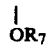

(VIII)

wherein $R_7$ represents an unsubstituted or substituted aryl group or an unsubstituted or substituted heterocyclic group

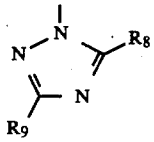

[IX]

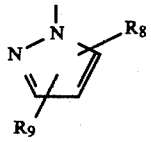

[X]

wherein $R_8$ and $R_9$, which may be the same or different, each represents a hydrogen atom, a halogen atom, a carboxylic acid ester group, an amino group, an alkyl group, an alkylthio group, an alkoxy group, an alkylsulfonyl group, a carboxylic acid group, a sulfonic acid group, an unsubstituted or substituted aryl group or an unsubstituted or substituted heterocyclic group

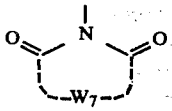

[XI]

wherein $W_1$ represents non-metallic atoms necessary to form a 4-membered ring, a 5-membered ring or a 6-membered ring together with

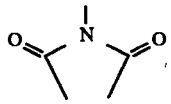

18. A silver halide color photographic light-sensitive material as claimed in claim 17, wherein the group represented by the general formula (XI) is a group represented by the following general formula (XII), (XIII) or (XIV):

[XII]

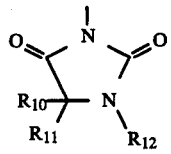

[XIII]

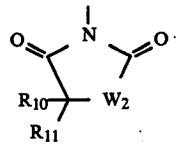

[XIV]

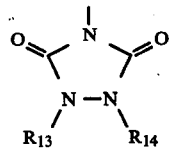

wherein $R_{10}$ and $R_{11}$, which may be the same or different, each represents a hydrogen atom, an alkyl group, an aryl group, an alkoxy group, an aryloxy group or a hydroxy group; $R_{12}$, $R_{13}$ and $R_{14}$, which may be the same or different, each represents a hydrogen atom, an alkyl group, an aryl group, an aralkyl group or an acyl group, and $W_2$ represents an oxygen atom or a sulfur atom.

19. A silver halide color photographic light-sensitive material as claimed in claim 4, wherein the non-color forming ethylenically unsaturated monomer used in the second stage polymerization is a monomer selected from the group consisting of an acrylic acid ester, an acrylic acid amide, a vinyl ester, an acrylonitrile, an aromatic vinyl compound, itaconic acid, citraconic acid, crotonic acid, vinylidene chloride, a vinyl alkyl ether, an ester of maleic acid, N-vinyl-2-pyrrolidone, N-vinyl pyridine, or 2- or 4-vinyl pyridine.

20. A silver halide color photographic light-sensitive material as claimed in claim 4, wherein the organic solvent is substantially inert to the solid water-insoluble monomer coupler, does not interrupt a normal action of the free-radical adition polymerization and has a low boiling point so as to be capable of being easily removed by distillation from the aqueous reaction medium.

21. A silver halide color photographic light-sensitive material as claimed in claim 21, wherein the organic solvent is selected from the group consisting of a lower alcohol containing 1 to 4 carbon atoms, a ketone, a chlorinated hydrocarbon, an aromatic hydrocarbon, a cyclic ether, an ester or a nitrile.

22. A silver halide color photographic light-sensitive material as claimed in claim 1, wherein the copolymer coupler latex is incorporated into a silver halide emulsion layer.

23. A silver halide color photographic light-sensitive material as claimed in claim 1, wherein the copolymer coupler latex is incorporated into a layer adjacent to the silver halide emulsion layer.

24. A silver halide color photographic light-sensitive material as claimed in claim 23, wherein the silver halide emulsion layer is a blue-sensitive silver halide emulsion layer, a green-sensitive silver halide emulsion layer or a red-sensitive silver halide emulsion layer.

25. A method of forming a color image comprising developing an imagewise exposed silver halide color photographic light-sensitive material comprising a support having thereon a layer containing at least one copolymer coupler latex having a layered structure having an outer layer containing a polymer made from at least one monomer coupler capable of forming a dye upon coupling with an oxidation product of an aromatic primary amine developing agent and an inner layer which does not have the capability of forming a dye upon coupling with the oxidation product of an aromatic primary amine developing agent, and said developing is conducted using an alkaline aqueous solution containing an aromatic primary amine developing agent.

26. The method of claim 25 wherein the copolymer coupler latex has a structure in which a plurality of component polymers having a different chemical composition and rate of composition are randomly distributed in an inner layer (core) and in an outer layer (shell) of a polymer particle.

27. A method as claimed in claim 25 wherein the copolymer coupler latex is a copolymer coupler latex prepared by a method in which (a) at least one ethylenically unsaturated monomer incapable of oxidative coupling with an aromatic primary amine developing agent is subjected to emulsion polymerization to prepare a polymer latex in a first stage polymerization, and then (b) a monomer coupler capable of forming a dye upon coupling with an oxidation product of an aromatic primary amine developing agent and a non-color forming ethylenically unsaturated monomer are subjected to emulsion polymerization in an aqueous reaction medium containing an organic solvent in a second stage polymerization.

* * * * *